US008135298B2

(12) United States Patent
Ogiso et al.

(10) Patent No.: US 8,135,298 B2
(45) Date of Patent: Mar. 13, 2012

(54) IMAGE FORMING APPARATUS AND IMAGE FORMING METHOD FOR CONTROLLING IMAGE FORMATION BASED ON A TEMPERATURE OF A FUSING ROTATING BODY

(75) Inventors: Toshio Ogiso, Tokyo (JP); Shin Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 473 days.

(21) Appl. No.: 12/289,256

(22) Filed: Oct. 23, 2008

(65) Prior Publication Data

US 2009/0110418 A1 Apr. 30, 2009

(30) Foreign Application Priority Data

Oct. 31, 2007 (JP) ..... 2007-284260

(51) Int. Cl.
*G03G 15/20* (2006.01)

(52) U.S. Cl. ..... 399/69; 219/216

(58) Field of Classification Search ..... 399/69, 399/70, 68; 219/216; 347/156
See application file for complete search history.

(56) References Cited

U.S. PATENT DOCUMENTS

| | | | | |
|---|---|---|---|---|
| 5,621,511 | A * | 4/1997 | Nakayama | 399/69 X |
| 2005/0265741 | A1 * | 12/2005 | Otsuka | 399/69 |
| 2007/0059003 | A1 * | 3/2007 | Shinshi et al. | 399/68 X |
| 2007/0140752 | A1 | 6/2007 | Yamamoto et al. | 399/323 |
| 2007/0172278 | A1 | 7/2007 | Yamamoto | 399/405 |
| 2008/0013993 | A1 | 1/2008 | Obata et al. | 399/331 |
| 2008/0056783 | A1 | 3/2008 | Yamamoto et al. | 399/329 |
| 2008/0069611 | A1 | 3/2008 | Obata et al. | 399/331 |
| 2008/0193162 | A1 | 8/2008 | Yamazoe et al. | 399/121 |
| 2009/0003868 | A1 * | 1/2009 | Namiki et al. | 399/69 |

FOREIGN PATENT DOCUMENTS

| | | |
|---|---|---|
| JP | 4-68776 | 3/1992 |
| JP | 05-273890 | 10/1993 |
| JP | 08-262896 | 10/1996 |
| JP | 11-338303 | 12/1999 |
| JP | 2005-3870 | 1/2005 |
| JP | 2006-194966 | 7/2006 |
| JP | 2006-201636 | 8/2006 |

OTHER PUBLICATIONS

Abstract of JP 2006-194966 published Jul. 27, 2006.
Abstract of JP 05-273890 published Oct. 22, 1993.

* cited by examiner

*Primary Examiner* — Sophia S Chen
(74) *Attorney, Agent, or Firm* — Harness, Dickey & Pierce, PLC

(57) ABSTRACT

An image forming apparatus, such as a printer, includes an image forming unit forming a toner image on an image carrier, a transfer unit for transferring the toner image onto a recording medium, a pair of a fusing rotating body and a pressure rotating body, a fusing unit for fusing the toner image on the recording medium, a temperature detecting unit for detecting the temperature on the surface of the fusing rotating body, and a control unit. An amount of decrease in the temperature of the fusing rotating body surface is measured at a predetermined time, and the time between an image formation request and the arrival of the recording medium, with the toner image formed thereon, at a fusing/nipping portion formed between the fusing rotating body and the pressure rotating body is extended when the temperature decrease amount is greater than a threshold value.

4 Claims, 25 Drawing Sheets

FIG.23

| | NORMAL Ttar NOT RESUMED | NORMAL Ttar RESUMED |
|---|---|---|
| STACKING DEFECT | YES | NO |

| HUMIDITY (%) | AR (s) |
|---|---|
| < 59 | 0 |
| 60 – 79 | 30 |
| > 80 | 60 |

FIG.30

| CURL REDUCTION MODE | AR (s) |
|---|---|
| NO CURL REDUCTION | 0 |
| LIGHT | 30 |
| HEAVY | 60 |

IMAGE FORMING APPARATUS AND IMAGE FORMING METHOD FOR CONTROLLING IMAGE FORMATION BASED ON A TEMPERATURE OF A FUSING ROTATING BODY

BACKGROUND OF THE INVENTION

1. Field of the Invention

The present invention relates to image forming apparatuses, such as copy machines, facsimile machines, and printers, and to image forming methods.

2. Description of the Related Art

In an image forming apparatus based on an electrophotographic technology, coloring particles of toner are used to produce a toner image on a recording material surface in an image formation step. This is followed by a fusing step in which the formed toner image is fused onto the recording material, wherein the toner is melted by heat and then solidifies upon cooling.

A conventional fusing device for fusing a toner image on the recording material surface includes a fusing roller and a pressure roller. The fusing roller is a fusing rotating body that has a heating unit, such as a halogen heater, disposed inside the rotating body. The pressure roller is a pressure rotating body that is pressed against the fusing roller by a coil spring or the like, forming a nipping portion between the pressure roller and the fusing roller. In such a fusing device, a recording material carrying a toner image on the surface thereof is passed through the nipping portion between the fusing roller and the pressure roller, and heat and pressure are applied in order to fuse the toner image on the recording material.

In this type of a fusing device, in order to fuse the toner image onto the recording material, such as a transfer sheet, without damaging the image quality, it is necessary to maintain a target temperature of the fusing roller, by which an amount of heat is supplied to the toner image at the nipping portion. If the temperature is either too high or too low, an image defect called "offset" or "fusing defect" may be caused. Thus, it is important to maintain an appropriate fusing temperature of the fusing roller.

Thus, the temperature on the surface of the fusing roller is detected by a temperature sensor as a fusing temperature detecting unit, and the heating unit is controlled based on a detected result so that an appropriate fusing temperature can be maintained.

However, immediately after the turning on of power, the temperature of the pressure roller may be low even when the fusing roller surface has reached a predetermined temperature through a warm-up operation. This is due to the fact that, because the fusing roller is heated to the predetermined temperature without rotating the pair of the fusing roller and the pressure roller, only a portion of the surface of the pressure roller that is in contact with the fusing roller is heated, leaving the other surface portions of the pressure roller unheated. As a result, when the pair of the fusing roller and the pressure roller are rotated in response to an image formation request immediately after a warm-up operation, the portions of the pressure roller that have a lower surface temperature come into contact with the surface of the fusing roller, whereby the heat of the fusing roller is taken away and the surface temperature of the fusing roller decreases.

Eventually, as the pressure roller surface is heated, the surface temperature of the fusing roller rises to the predetermined temperature. However, the recording material may have already passed the nipping area when the surface temperature of the fusing roller has recovered, thereby resulting in a fusing defect.

Japanese Laid-Open Patent Application No. 8-262896 discloses that a pressure roller temperature is estimated from the difference between an actual surface temperature of the fusing roller when it is heated by a warm-up operation, and a target temperature of the fusing roller. When the estimated pressure roller temperature is too low, the time between an image formation request and the arrival of the recording material with a toner image formed thereon at the fusing/nipping portion is extended.

By thus increasing the time between the instruction for image formation and the arrival of the recording material at the fusing/nipping portion, the surface temperature of the fusing roller that has dropped due to the transfer of heat to the pressure roller can recover back to the target temperature when the recording material passes through the fusing/nipping portion.

In this way, the development of fusing defect can be prevented. In this conventional technology, when it is estimated that the temperature of the pressure roller is sufficiently high, no extension of time is made between the reception of an instruction for image formation and the arrival of the recording material at the fusing/nipping portion, so that the first print time can be shortened.

However, in the above-discussed conventional technology, the temperature of the pressure roller after the warm-up operation may not be correctly estimated due to various factors, such as the eccentricity in the fusing roller or the pressure roller. For example, if there is eccentricity in the fusing roller, for example, the nipping width when the roller is stopped varies. When the nipping width in the absence of rotation is narrower, less heat taken is away by the pressure roller. Thus, the actual surface temperature of the fusing roller decreases less when the fusing roller is heated through the warm-up operation to a target temperature. As a result, it is wrongly estimated that the temperature of the pressure roller is sufficiently high when in fact the temperature of the pressure roller is low.

If this happens, the surface temperature of the fusing roller greatly decreases once the rollers are rotated, and yet the time before the arrival of the recording material at the fusing/nipping portion is not extended even though such extension of time is required for the surface temperature of the fusing roller to reach the target temperature.

Consequently, the recording material arrives at the fusing/nipping portion before the surface temperature of the fusing roller has recovered sufficiently, thereby resulting in a fusing defect. Particularly, when the fusing roller has a high thermal responsiveness, the actual temperature of the fusing roller surface may greatly vary due to factors such as the eccentricity in the fusing roller or the pressure roller, thereby increasing the probability of the development of a fusing defect.

SUMMARY OF THE INVENTION

It is a general object of the present invention to provide a novel and useful image forming apparatus and image forming method in which one or more of the aforementioned problems of the related art are eliminated.

In one aspect, the invention provides an image forming apparatus comprising an image forming unit configured to form a toner image on an image carrier; a transfer unit configured to transfer the toner image on the image carrier to a recording medium; a fusing rotating body that is heated by a heating unit; a pressure rotating body that contacts the fusing rotating body to form a fusing/nipping portion between the fusing rotating body and the pressure rotating body, the fusing rotating body and the pressure rotating body forming a fusing rotating body pair; a fusing device configured to cause the recording medium to pass through the fusing/nipping portion and configured to fuse the toner image on the recording medium onto the recording medium; a temperature detecting unit configured to detect a temperature on a surface of the fusing rotating body; and a control unit. The control unit is configured to cause the fusing rotating body pair to be rotated in response to an image formation request, detect an amount of decrease in the temperature of the fusing rotating body surface at a predetermined time with the temperature detecting unit, and extend a time between the image formation request and an arrival of the recording medium with the toner image formed thereon at the fusing/nipping portion when the temperature decrease amount is greater than a threshold value.

In a preferred embodiment, the control unit extends the time between the image formation request and the arrival of the recording medium with the toner image formed thereon at the fusing/nipping portion by delaying the start of formation of the toner image on the image carrier.

In a preferred embodiment, when the temperature decrease amount is greater than the threshold value, the control unit is configured to start the formation of the toner image on the image carrier upon the fusing rotating body or the pressure rotating body reaching a predetermined temperature.

In another preferred embodiment, the apparatus includes a room temperature detecting unit configured to detect a room temperature. When the temperature decrease amount is greater than the threshold value, the control unit starts the formation of the toner image on the image carrier either after a predetermined time or upon the fusing rotating body or the pressure rotating body reaching the predetermined temperature, based on a result of detection by the room temperature detecting unit.

In a preferred embodiment, the control unit is configured to start the formation of the toner image upon the fusing rotating body or the pressure rotating body reaching the predetermined temperature when the room temperature is 15° C. or lower. The control unit starts the image formation on the image carrier after a predetermined time when the room temperature exceeds 15° C.

In a preferred embodiment, the control unit is configured to raise a fusing target temperature, which is a target in controlling a heating amount of the heating unit when the toner image is fused on the recording medium, to a fusing target temperature higher than normal, when the temperature decrease amount is greater than the threshold value.

In another preferred embodiment, the control unit is configured to resume a normal fusing target temperature when a number of sheets for continuous image formation exceeds a threshold value.

In another preferred embodiment, the control unit is configured to rotate the fusing rotating body pair for a predetermined time for a follow-up rotation after the toner image on the recording medium is fused onto the recording medium, when the temperature decrease amount is greater than the threshold value.

In another preferred embodiment, the control unit is configured to change a standby target temperature, which is a target in controlling a heating amount of the heating unit in a standby status, to a standby target temperature that is higher than normal, when the temperature decrease amount is greater than the threshold value.

In another preferred embodiment, the apparatus includes a humidity detecting unit configured to detect a room humidity. The control unit is configured to extend the time before the recording medium with the toner image formed thereon arrives at the fusing/nipping portion, when the room humidity is greater than a threshold value.

In a preferred embodiment, the control unit is configured to allow a user to select whether the time before the recording medium with the toner image formed thereon arrives at the fusing/nipping portion should be extended, using an operating unit with which the user can enter an instruction into the apparatus.

In another aspect, the invention provides an image forming method comprising the steps of forming a toner image on an image carrier; transferring the toner image on the image carrier onto a recording medium; transporting the recording medium between a fusing/nipping portion formed between a fusing rotating body that is heated by heating unit and a pressure rotating body that contacts the fusing rotating body, the fusing rotating body and the pressure rotating body forming a fusing rotating body pair; fusing the toner image on the recording medium with heat and pressure; rotating the fusing rotating body pair in response to an image formation request; detecting an amount of decrease in the temperature on a surface of the fusing rotating body at a predetermined time; and, when the temperature decrease amount is greater than a threshold value, extending a time between the image formation request and an arrival of the recording medium with the toner image formed thereon at the fusing/nipping portion.

BRIEF DESCRIPTION OF THE DRAWINGS

These and other objects, features and advantages of the invention will be apparent to those skilled in the art from the following detailed description of the invention, when read in conjunction with the accompanying drawings in which:

FIG. 23 shows a result of examining a stack defect in a continuous print process;

FIG. 30 shows a relationship between user set modes and the advance rotation time.

DETAILED DESCRIPTION OF THE PREFERRED EMBODIMENTS

In the following, a printer as an image forming apparatus based on an electrophotographic technology according to an embodiment of the present invention is described.

Figure 1:
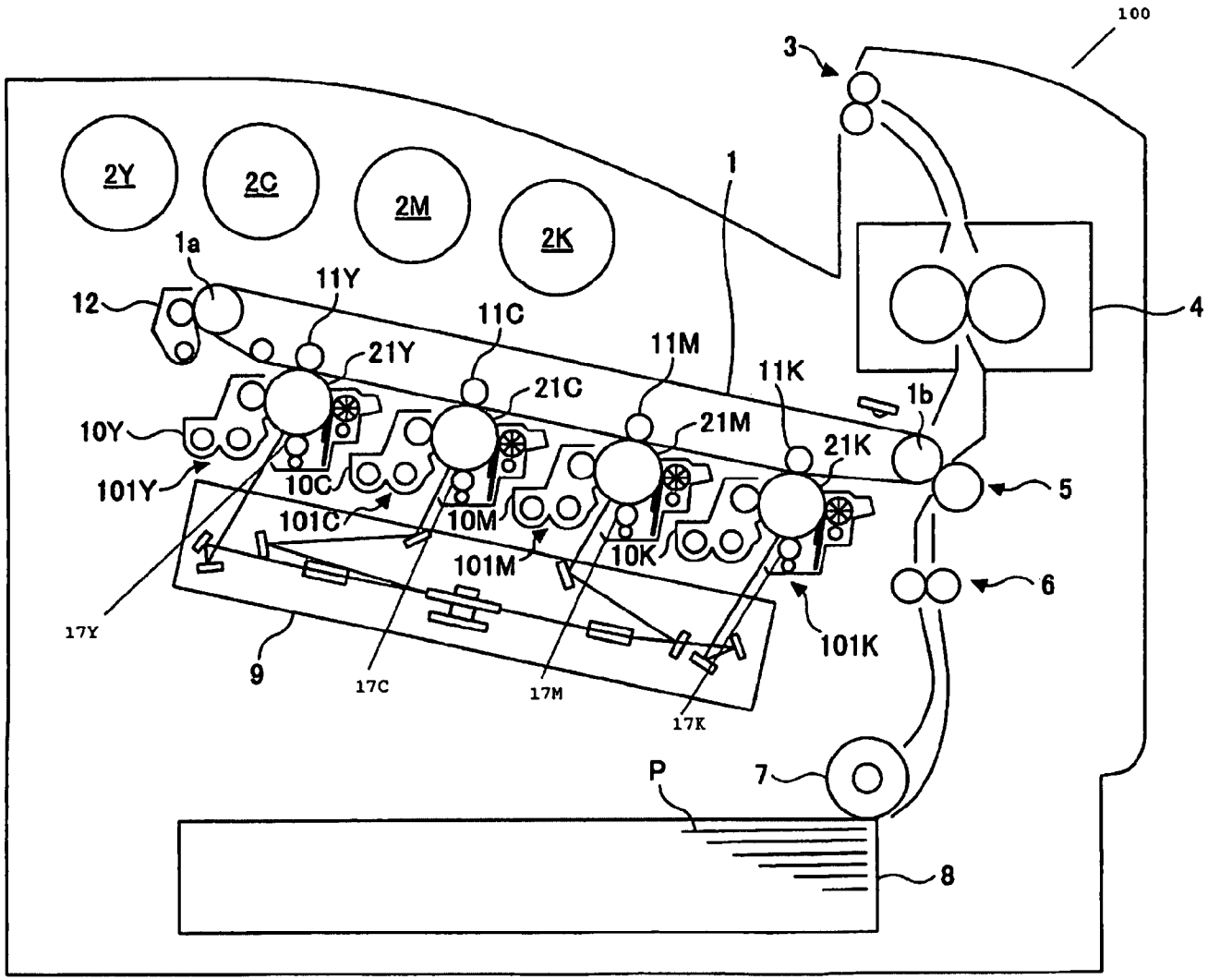
FIG. 1 shows a schematic diagram of a printer according to an embodiment of the present invention.

FIG. 1 shows a schematic diagram of a printer 100. The printer 100 includes four image forming units for the colors of yellow, cyan, magenta, and black that are arranged laterally, thereby forming a tandem image formation unit.

In the tandem image formation unit, toner image formation units 101Y, 101C, 101M, and 101K, which are the individual image forming units, are arranged from left to right in the drawing sheet. The letters Y, C, M, and K indicate the colors of yellow, cyan, magenta, and black, respectively.

In the tandem image formation unit, each of the toner image formation units 101Y, 101C, 101M, and 101K includes a drum-shaped photosensitive body 21Y, 21C, 21M, or 21K as an image carrier. Around each of the image carriers, there are provided a charging device 17Y, 17C, 17M, or 17K, a developing device 10Y, 10C, 10M, or 10K, and a photosensitive body cleaning device.

In an upper portion of the printer 100, there are disposed toner bottles 2Y, 2C, 2M, and 2K which are filled with yellow, cyan, magenta, and black toners, respectively. From these toner bottles 2Y, 2C, 2M, and 2K, a predetermined supply amount of toner of each color is supplied to the developing devices 10Y, 10C, 10M, and 10K via transport paths which are not shown.

Underneath the tandem image formation unit, there is provided an optical writing unit 9 as a latent image forming unit. The optical writing unit 9 includes a light source, a polygon mirror, an f-θ lens, and a reflecting mirror. The optical writing unit 9 is configured to scan the surface of each of the photosensitive bodies 21 with laser light based on image data.

Immediately above the tandem image formation unit, there is provided a transfer unit that includes an intermediate transfer belt 1, which is an endless belt as an intermediate transfer body, a primary transfer device, and a secondary transfer roller. The intermediate transfer belt 1 is wound across support rollers 1*a* and 1*b*. The support roller 1*a* is a drive roller whose rotation shaft is coupled with a drive motor, which is not shown. The drive motor moves the intermediate transfer belt 1 in an anticlockwise direction in the drawing, thereby also rotating the support roller 1*b*, which is a driven roller.

Inside the intermediate transfer belt 1, there are disposed primary transfer devices 11Y, 11C, 11M, and 11K for transferring toner images formed on the photosensitive bodies 21Y, 21C, 21M, and 21K onto the intermediate transfer belt 1.

Downstream of the primary transfer devices 11Y, 11C, 11M, and 11K in the direction in which the intermediate transfer belt 1 is driven, there is provided a secondary transfer roller 5 as a secondary transfer device. On the opposite side of the secondary transfer roller 5 across the intermediate transfer belt 1, there is disposed the support roller 1*b*, functioning as a pressing member.

The printer 100 also includes a sheet-feeding cassette 8 containing transfer sheets P as a recording material, a feed roller 7, and a resist roller 6. Downstream of the secondary transfer roller 5 with respect to the direction of travel of the transfer sheet P on which the toner image is transferred by the secondary transfer roller 5, there is provided a fusing device 4 for fusing the image on the transfer sheet P, and a sheet ejecting roller 3.

An operation of the printer 100 is described. In the toner image formation units 101Y, 101C, 101M, and 101K, the photosensitive bodies 21Y, 21C, 21M, and 21K are rotated. As the photosensitive bodies 21Y, 21C, 21M, and 21K rotate, their surfaces are uniformly charged by the charging devices 17Y, 17C, 17M, and 17K, respectively.

The photosensitive bodies 21Y, 21C, 21M, and 21K are then irradiated with laser light emitted by the optical writing unit 9 in accordance with image data, thereby forming a static latent image on each of the photosensitive bodies.

The static latent images are made visible by the developing devices 10Y, 10C, 10M, and 10K, using the toners, whereby single-color images of yellow, cyan, magenta, and black are formed on the photosensitive bodies 21Y, 21C, 21M, and 21K, respectively.

The drive roller 1*a* is rotated by the drive motor not shown to drive the driven roller 1*b* and the secondary transfer roller 5, whereby the intermediate transfer belt 1 is rotated, and the visible images are successively transferred onto the intermediate transfer belt 1 by the primary transfer devices 11Y, 11C, 11M, and 11K. In this way, a composed color image is formed on the intermediate transfer belt 1. The surface of the photosensitive bodies 21Y, 21C, 21M, and 21K after image transfer is cleaned by the photosensitive body cleaning devices to remove remaining toner and prepare for the next run of image formation.

In synchronism with the timing of image formation as described above, one of the transfer sheets P is taken out of the sheet-feeding cassette 8 by the feed roller 7 and transported to the resist roller 6 where the transfer sheet P is once stopped. At an appropriate timing with reference to the image formation operation, the transfer sheet P is conveyed between the secondary transfer roller 5 and the intermediate transfer belt 1.

The intermediate transfer belt 1 and the secondary transfer roller 5 form the so-called "secondary transfer nip" across the transfer sheet P, where the toner image on the intermediate transfer belt 1 is secondarily transferred onto the transfer sheet P using the secondary transfer roller 5.

The transfer sheet P after image transfer is fed to the fusing device 4 whereby heat and pressure are applied to fuse the transferred image, after which the transfer sheet P is ejected out of the apparatus. The intermediate transfer belt 1 after image transfer is cleaned by the intermediate transfer body cleaning device 12 to remove remaining toner on the intermediate transfer belt 1, thus preparing the belt for the next round of image formation by the tandem image formation unit.

Each of the toner image formation units 101Y, 101C, 101M, and 101K is an integrally formed process cartridge that can be attached to and detached from the main body. These integral process cartridges can be moved along guide rails (not shown) fixed to the printer 100 main body, so that they can be drawn out of the front of the printer 100 main body. By pressing the process cartridges into the printer 100 main body, the toner image formation units 101Y, 101C, 101M, and 101K can be loaded at their predetermined positions.

The process cartridges, i.e., the individual toner image formation units 101Y, 101C, 101M, and 101K, have the same structure and operate in the same way. Thus, in the following, the process cartridges are described in detail omitting the letters Y, C, M, or K, with reference to FIG. 2.

Figure 2:
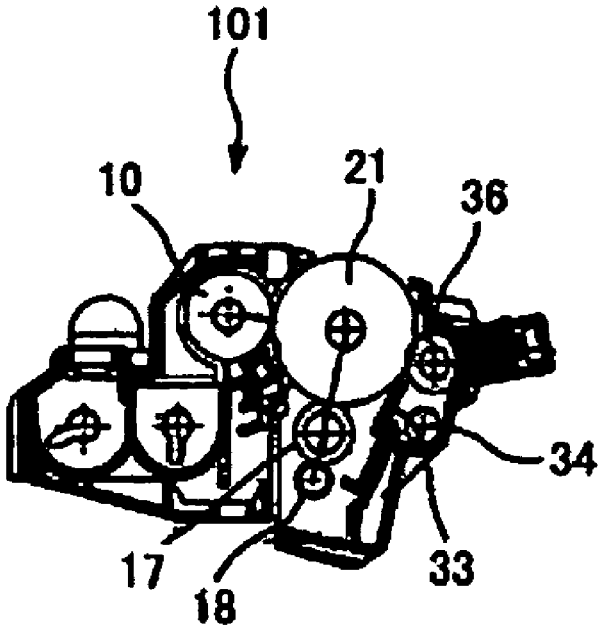
FIG. 2 shows a schematic diagram of a process cartridge that is a toner image formation unit of the printer shown in FIG. 1.

FIG. 2 schematically shows one of the process cartridges. As shown, the process cartridge 101 includes a photosensitive body 21 that rotates in the clockwise direction in the drawing. Around the photosensitive body 21, there are disposed a charging roller 17 as a charging device, a developing device 10, a fur brush 36 as part of a photosensitive body cleaning device, and a cleaning blade 33.

Thus, in the printer 100, the charging roller 17 is disposed vertically below the photosensitive body 21. Under the charging roller 17, there is disposed a cleaning roller 18 as a charge cleaning roller that rotatably contacts the surface of the charging roller 17 to clean the surface. The photosensitive body cleaning device includes, in addition to the fur brush 36, a cleaning blade 33 and a waste toner transport coil 34 for removing waste toner scraped off the photosensitive body 21 out of the process cartridge.

Figure 3:
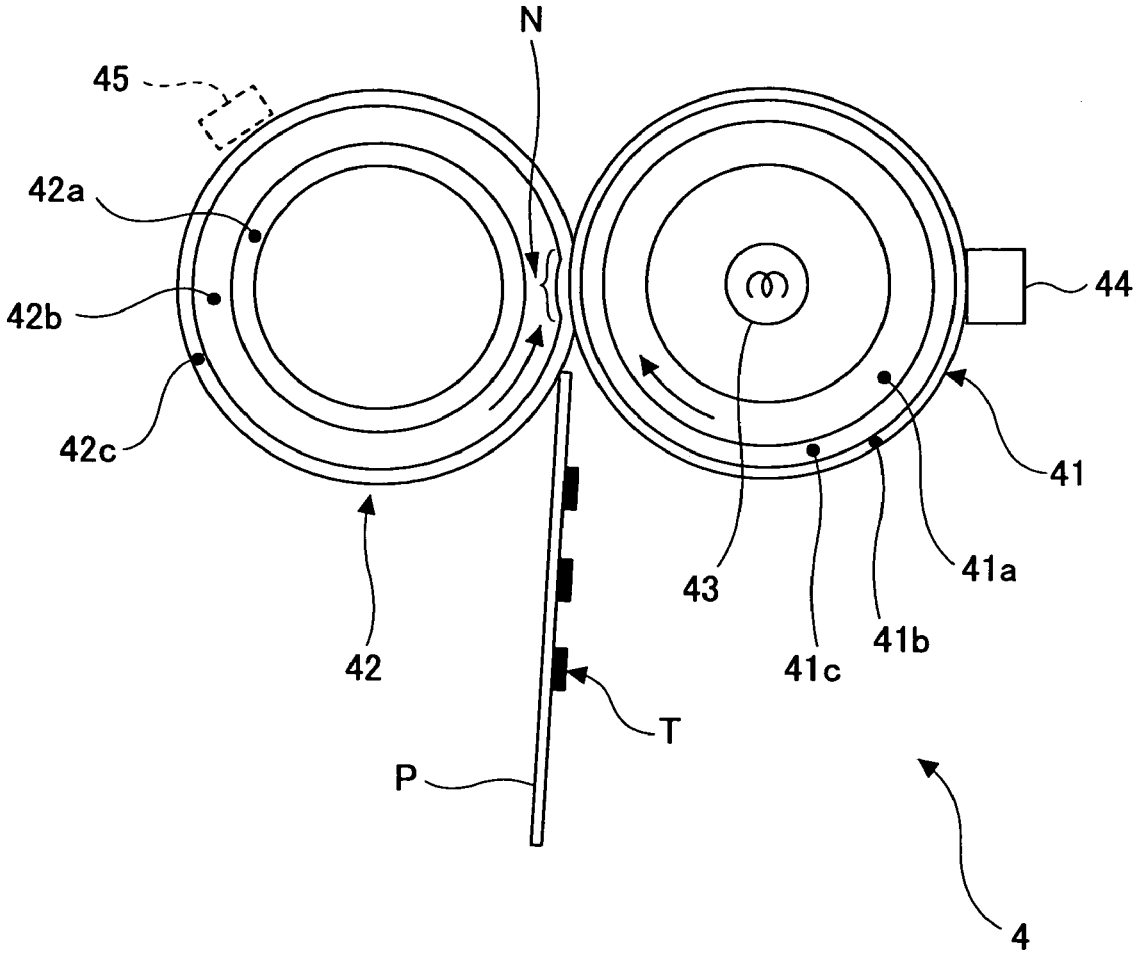
FIG. 3 shows a schematic diagram of a fusing device.

FIG. 3 shows a schematic diagram of the fusing device. The fusing device 4 includes a fusing roller 41 as a fusing rotating body, and a pressure roller 42 as a pressure rotating body. Inside the fusing roller 41, there is provided a heating member 43 that radiates heat with which the fusing roller 41 is heated from within. The heating member 43 may include a heating lamp such as a halogen lamp.

The fusing roller 41 and the pressure roller 42 are each rotatably supported by a support member which is not shown. The fusing roller 41 receives a rotating drive force from a fusing motor via gears (not shown) as a drive force transmitting member, whereby the fusing roller 41 is rotated in a direction indicated by an arrow.

The pressure roller 42 is biased toward the fusing roller 41 by a biasing member such as a spring, which is not shown. Thus, the fusing roller 41 and the pressure roller 42 are pressed against each other, thus forming a nipping portion N, which is a fusing position where the transfer sheet P passes. The nipping portion N has a width in the direction of movement of the transfer sheet. When the transfer sheet P passes the nipping portion N, a toner image T on the transfer sheet P that is yet to be fused is melted by heat, and is permanently fused on the transfer sheet P under pressure.

As the rotating drive force is transmitted to the fusing roller 41 and the fusing roller 41 rotates, the pressure roller 42 also rotates in a driven manner via the nipping portion N. In a preferred embodiment, a rotating drive force may also be transmitted to the pressure roller 42 via gears as a drive force transmitting member so that the surfaces of the two rollers can move at the same linear speed at the nipping portion N.

The pressure roller 42 includes a cylindrical metal core 42*a*, a resilient layer 42*b* provided on the surface of the metal core 42*a*, and a surface releasing layer 42*c* with which the outer peripheral surface of the resilient layer 42*b* is coated. The resilient layer 42*b* may be formed of an insulating resilient member such as silicone rubber.

Similarly, the fusing roller 41 includes a cylindrical metal core 41*a*, a resilient layer 41*b* provided on the surface of the metal core 41*a*, and a surface releasing layer 41*c* with which the external peripheral surface of the resilient layer 41*b* is coated. The thickness of the resilient layer 41*b* of the fusing roller 41 is reduced in order to reduce its heat capacity so that a warm-up time of 60 seconds or less can be achieved.

The temperature of the surface of the fusing roller 41 is detected by a temperature sensor 44, such as a thermistor. Based on a detected result, the heating member (such as a heating lamp) 43 is controlled to maintain a fusing target temperature.

Figure 4:
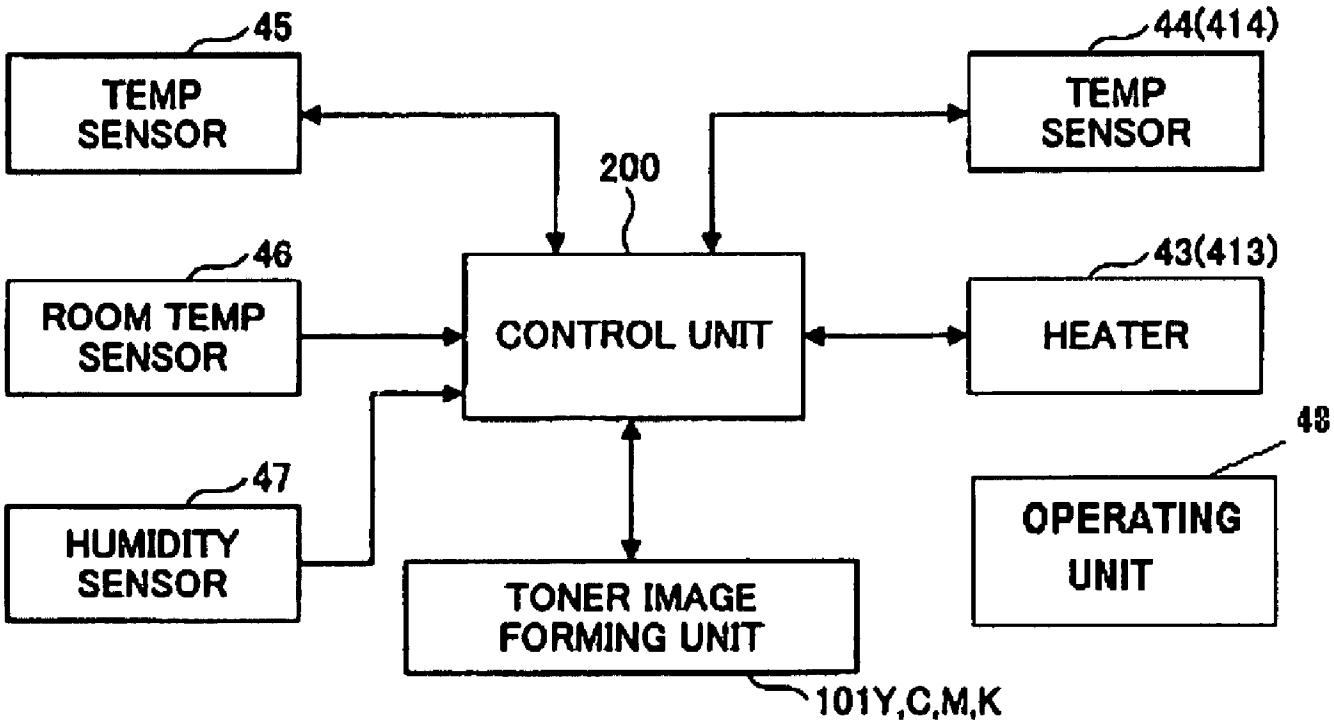
FIG. 4 shows a block diagram of a main electric circuit of the printer.

FIG. 4 shows a block diagram of a main electric circuit of the printer according to the present embodiment. A control unit 200 includes a central processing unit (CPU), a random access memory (RAM), and a read only memory (ROM). The control unit 200 controls the apparatus as a whole, and various units or sensors may be connected to the control unit 200 such as the temperature sensor 45, the temperature sensor 44, the heater 43, the room temperature sensor 46, the humidity sensor 47, the toner image forming unit 101Y, C, M, K, and an operating unit 48. The control unit 200 is configured to allow a user to select whether the time before the recording medium with the toner image formed thereon arrives at the fusing/nipping portion should be extended, using the operating unit 48 with which the user can enter an instruction into the apparatus. FIG. 4, however, shows only those units or sensors as they relate to the features of the copy machine 100.

The control unit 200 realizes the functions of the various units based on a control program stored in the RAM or ROM. Specifically, the control unit 200 functions as a temperature control unit to control the heating member 43 so that a fusing target temperature can be achieved. Further, as will be described later, the control unit 200, upon instruction for image formation, drives the fusing device 4 to rotate the fusing roller in advance for a predetermined time based on the amount of change in the surface temperature of the fusing roller.

Figure 5:
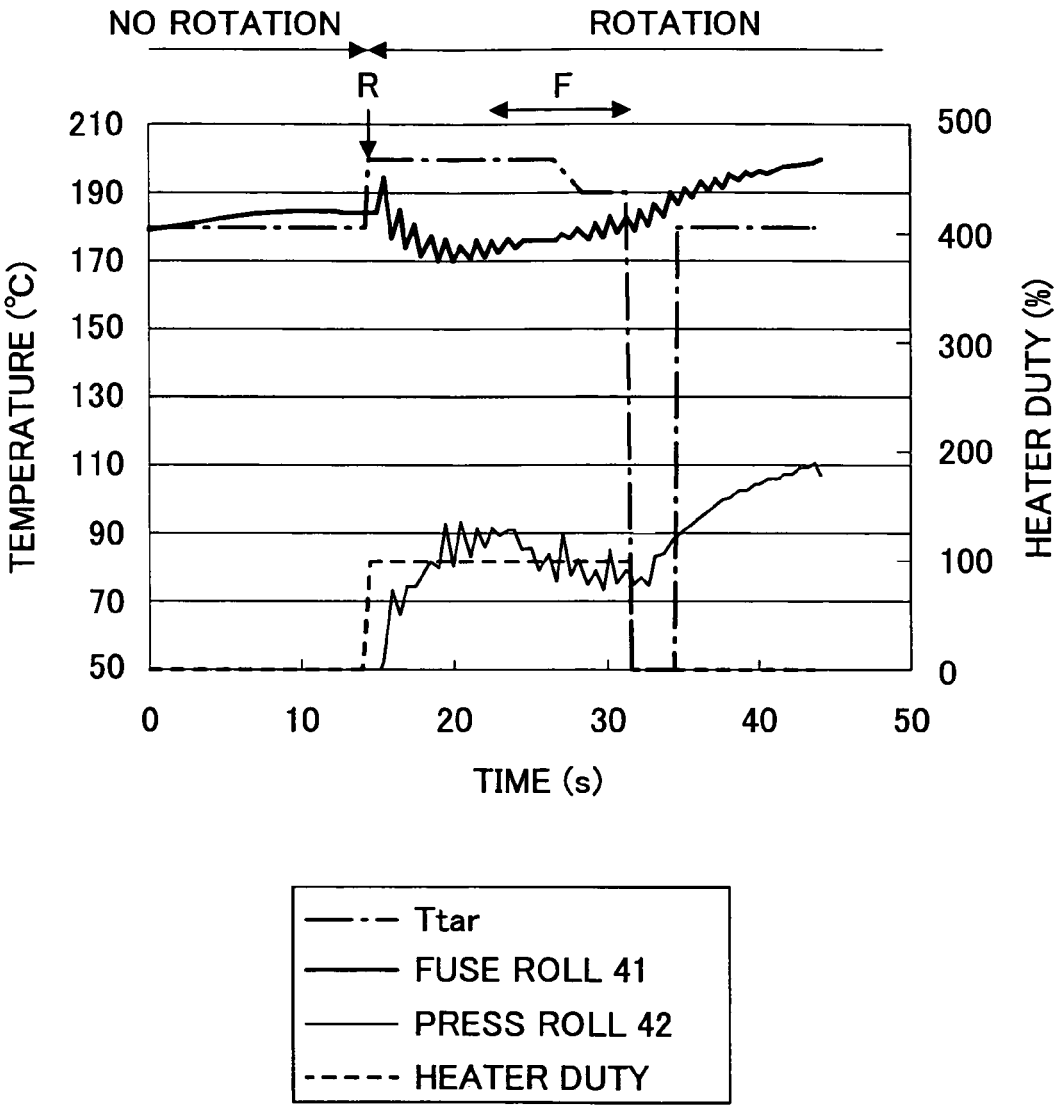
FIG. 5 shows a graph indicating temporal changes in the temperature of a fusing roller between the reception of an image formation request for a continuous print of three sheets and the start of a color image formation process.

FIG. 5 shows a graph indicating a result of an experiment measuring the fusing roller temperature between the reception of an image formation request for three continuous prints and the start of image formation. A temperature sensor 45 was also provided opposite the surface of the pressure roller 42 (indicated by the broken line in FIG. 3) to measure the surface temperature of the pressure roller 42. As shown in FIG. 5, in a standby status where the fusing roller 41 is not rotating, the surface temperature of the fusing roller 41 was about 180° C., which was about the same as a standby target temperature. On the other hand, the surface temperature of the pressure roller 42 was less than 50° C.

Upon reception of a color image formation request ("R"), the target temperature for controlling the heating amount of the heating member 43 is changed from the standby target temperature to a fusing target temperature ("Ttar"), followed by the rotation of the fusing roller 41. However, because the temperature of the pressure roller 42 is lower, heat is taken away by the pressure roller 42, resulting in a decrease in the surface temperature of the fusing roller 41. As a result, the surface temperature of the fusing roller 41 became greatly lower than the fusing target temperature Ttar. Thus, the surface temperature of the fusing roller 41 did not recover sufficiently and was lower than the fusing target temperature Ttar by more than 20 [deg] when the transfer sheet P was transported to the fusing nip where the toner image on the transfer sheet P was fused ("F"). Consequently, a fusing defect was caused in the printed image.

In order to solve this problem, in accordance with an embodiment of the present invention, when the temperature of the pressure roller 42 is low and the temperature of the fusing roller 41 decreases significantly, the time between the reception of an image formation request and the arrival of the transfer sheet P with a toner image formed thereon at the fusing nip is extended, so that the surface temperature of the fusing roller can sufficiently recover when the transfer sheet P passes the fusing nip.

Embodiment 1

In accordance with Embodiment 1, when the temperature of the fusing roller 41 decreases significantly, the start of image formation is delayed by a predetermined time.

Figure 6:
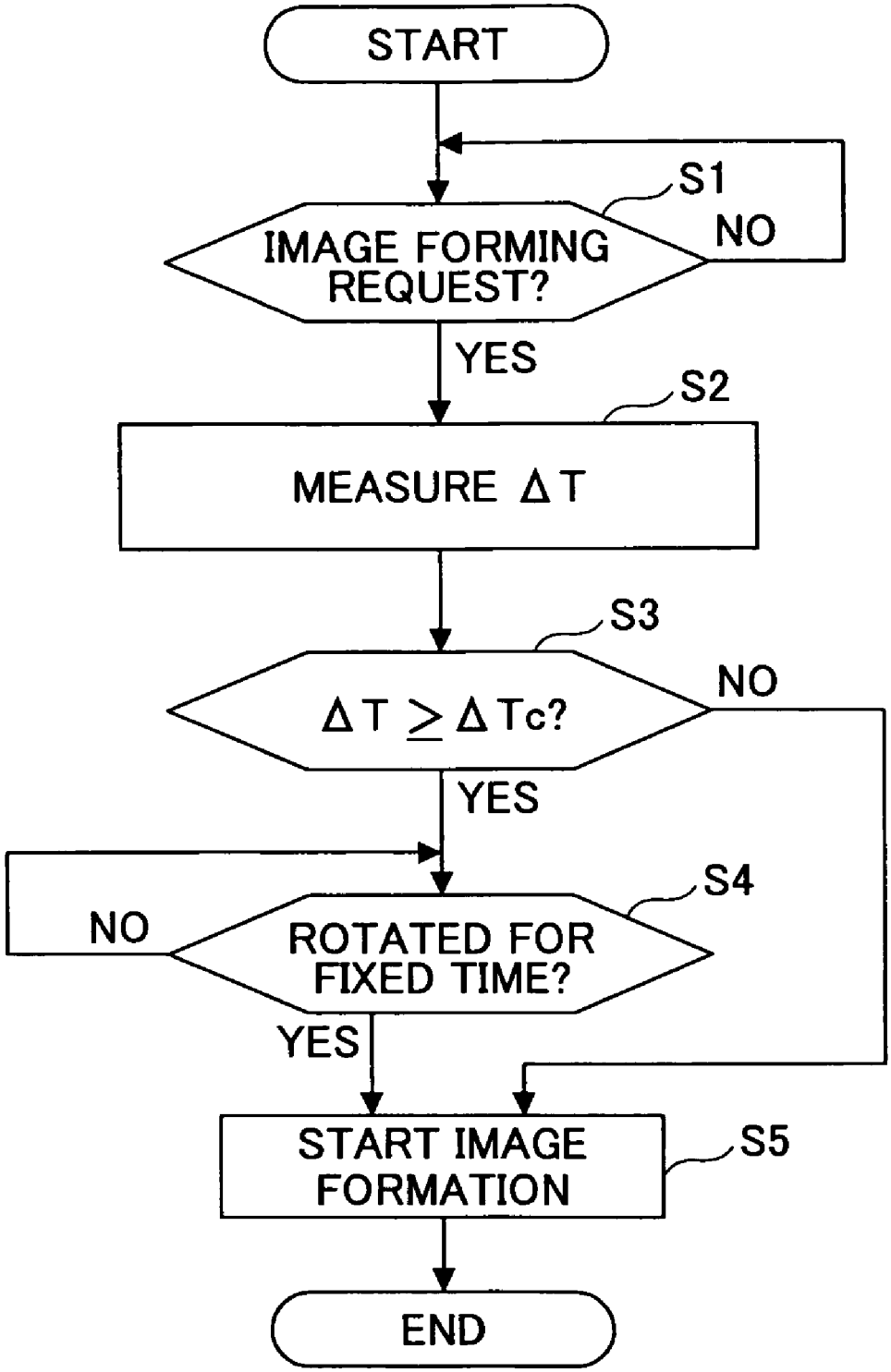
FIG. 6 shows a flowchart of an image formation process according to Embodiment 1.

FIG. 6 shows a flowchart of an image formation process according to the present embodiment.

Upon reception of an image formation request from a personal computer or the like ("YES" in S1), the control unit 200 causes the fusing roller 41 to be rotated for a predetermined measurement time Δt (3.2 seconds). A temperature decrease amount ΔT on the surface of the fusing roller 41 is detected (S2). The temperature decrease amount ΔT is obtained by subtracting the temperature of the fusing roller after the predetermined time Δt from the temperature of the fusing roller at the start of rotation. When the temperature decrease amount ΔT is greater than a threshold value ΔTc (7 [deg]; "YES" in S3), the start of the image formation operation is delayed by rotating the fusing roller 41 for five seconds in advance ("YES" in S4). Thereafter, the optical writing unit is operated and the image formation operation is started (S5). On the other hand, when the temperature decrease amount ΔT of the fusing roller surface is less than the threshold value ΔTc ("NO" in S3), image formation is started without such advance rotation.

Figure 7:
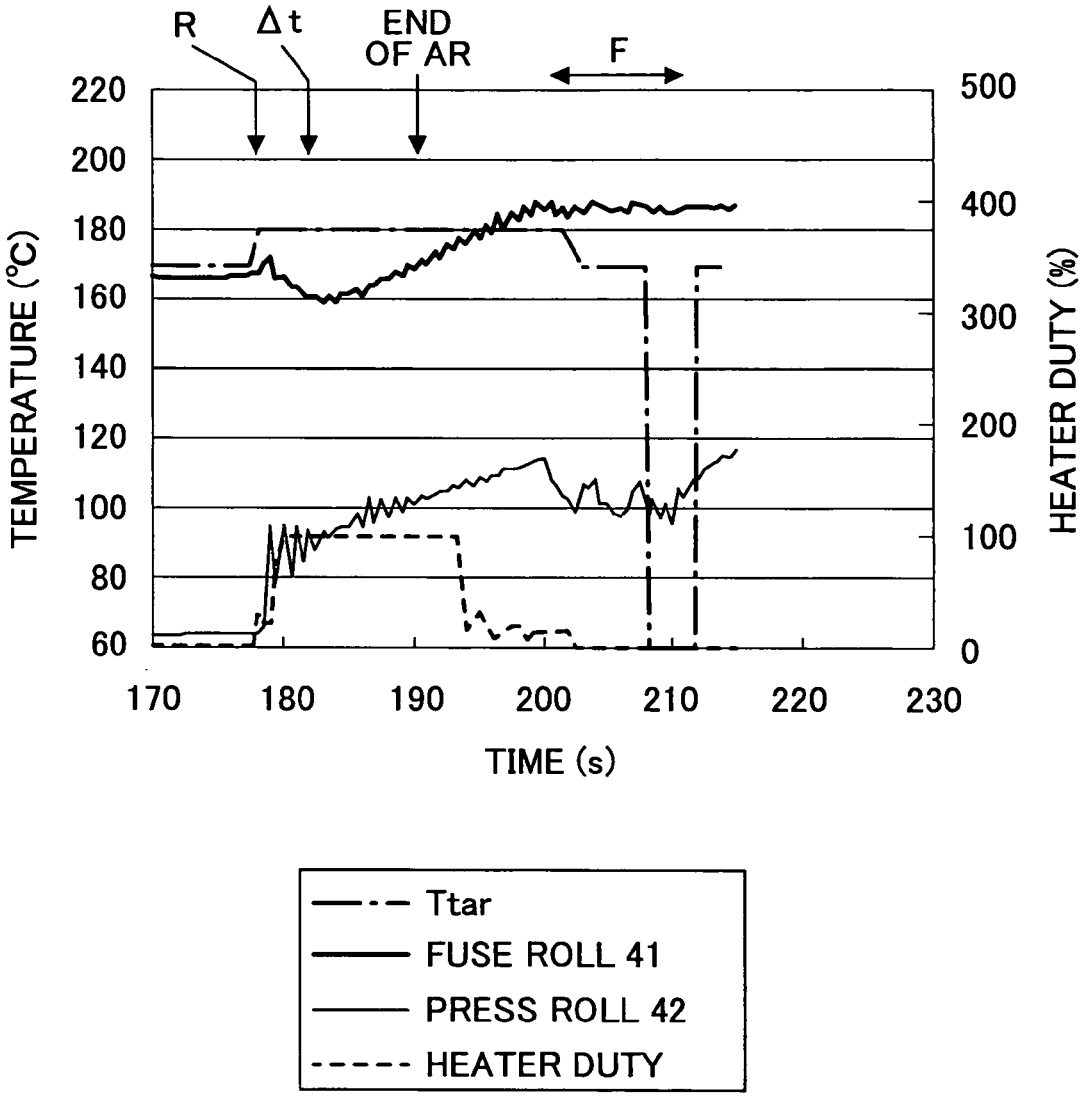
FIG. 7 shows a graph indicating the temporal changes in the temperature of the fusing roller between the reception of an image formation request for continuous printing of three sheets and the start of a color image formation process according to Embodiment 1, when the surface temperature of the pressure roller is low.
Figure 8:
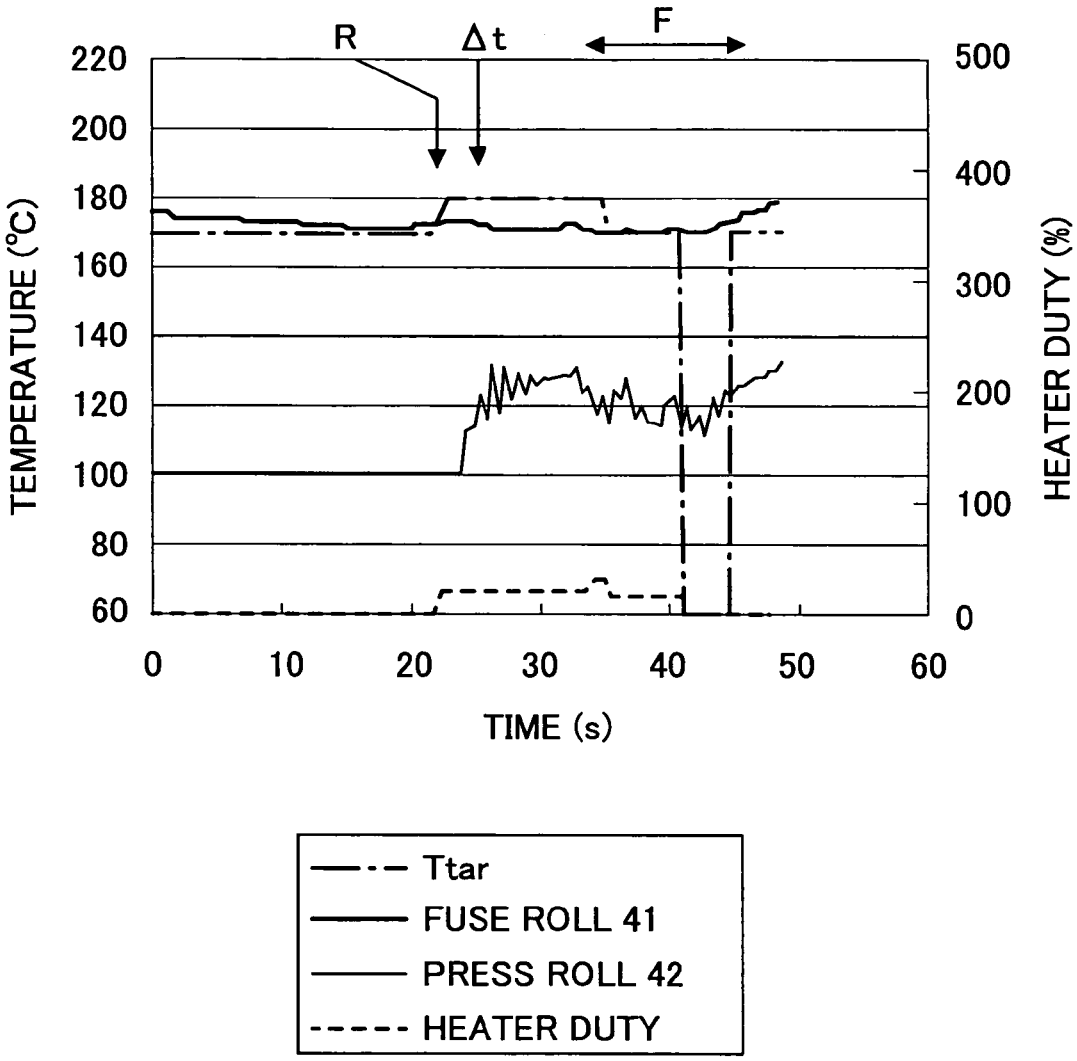
FIG. 8 shows a graph indicating the temporal changes in the temperature of the fusing roller between the reception of an image formation request for continuous printing of three sheets and the start of a color image formation process according to Embodiment 1, when the surface temperature of the pressure roller is high.

FIGS. 7 and 8 show graphs each indicating the result of an investigation measuring changes in the temperature of the fusing roller 41 before the fusing of images on transfer sheets P in an image formation process in accordance with Embodiment 1, when the temperature of the pressure roller 42 at standby was low (FIG. 7) and high (FIG. 8).

With reference to FIG. 7, when the temperature of the pressure roller 42 during standby was low, because heat was taken away from the fusing roller 41 by the pressure roller 42, the temperature decrease amount at the time Δt was more than 7 [deg]. In this case, the start of image formation was delayed by performing a 5-second advance rotation operation ("AR"). Thus, the time between the reception of an image formation request ("R") and the arrival of the transfer sheet with a toner image formed thereon at the fusing/nipping portion was extended. As a result, the fusing target temperature had been substantially fully recovered when the transfer sheet P passed the fusing nip (F), thereby obtaining an image without fusing defect.

Thus, the fusing roller pair are actually rotated so that it can be determined whether the start of image formation should be delayed by extending the time between an image formation request and the arrival of the transfer sheet at the fusing/nipping portion, based on an actual amount of temperature decrease on the fusing roller surface. In this way, it can be accurately estimated how much time is required before the temperature of the fusing roller surface substantially recovers to the fusing target temperature. By thus measuring the decrease amount of the temperature of the fusing roller surface based on an actual rotation of the fusing roller, whether or not to delay the start of image formation can be accurately determined even in the case of those fusing rollers having a high thermal responsiveness such that the temperature decrease amount greatly changes due to variations in the nip width or the like, and such that the surface temperature of the fusing roller can be raised to the fusing target temperature in a short warm-up time of less than 60 seconds.

On the other hand, when the temperature of the pressure roller 42 is rather high during standby as shown in FIG. 8, there is no temperature drop at the time Δt. Thus, if image formation is started immediately after Δt, an image without fusing defect can be obtained because the temperature of the fusing roller surface is substantially the same as the fusing target temperature Ttar when the transfer sheet P passes the fusing nip F. Thus, image formation can be started immediately after Δt in the absence of the temperature drop, so that the first print time can be shortened.

Figure 9:
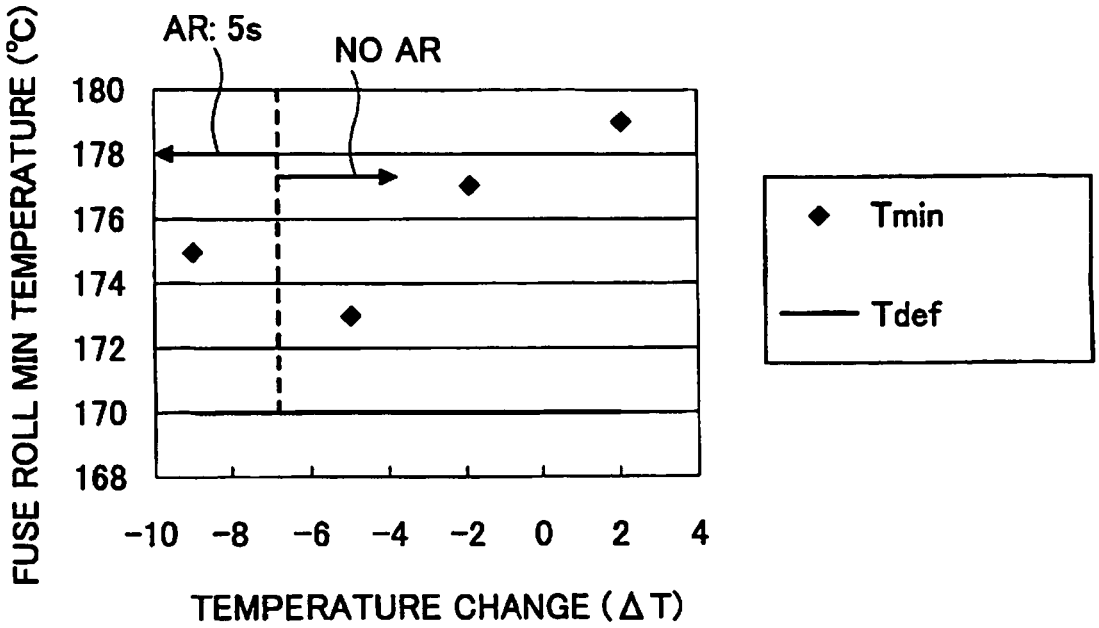
FIG. 9 shows a graph indicating the minimum temperature of the fusing roller surface immediately before image formation.
Figure 10:
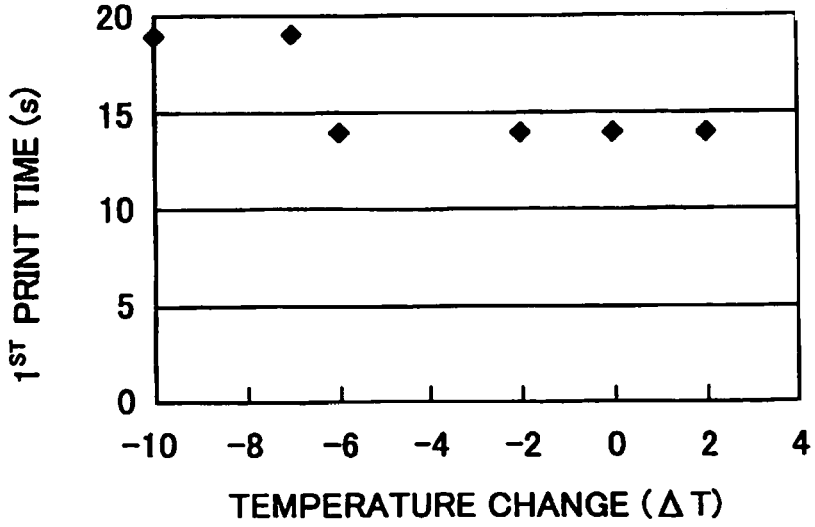
FIG. 10 shows a graph indicating the first print time when the image formation flow according to Embodiment 1 was performed.

FIG. 9 shows a graph indicating the relationship between the temperature decrease amount ΔT and a minimum temperature ("Tmin") of the fusing roller surface at the time of fusing. As shown, the minimum temperature Tmin of the fusing roller surface at the time of fusing was prevented from dropping below a minimum temperature for preventing fusing defects ("Tdef") by controlling the image formation process in accordance with Embodiment 1, thereby obtaining a good image. When the temperature decrease amount ΔT was less than 7 [deg] as shown in FIG. 10, the first print time was reduced more than in the case of the temperature decrease amount of 7 [deg] or greater.

In the present embodiment, the time Δt is 3.2 seconds, the threshold value ΔTc is 7 [deg], and the advance rotation time ("AR") for the fusing roller is five seconds. These values are merely exemplary and may be set as desired depending on the device structure, for example. The rotation time may be varied depending on the temperature decrease amount ΔT.

Embodiment 2

Figure 11:
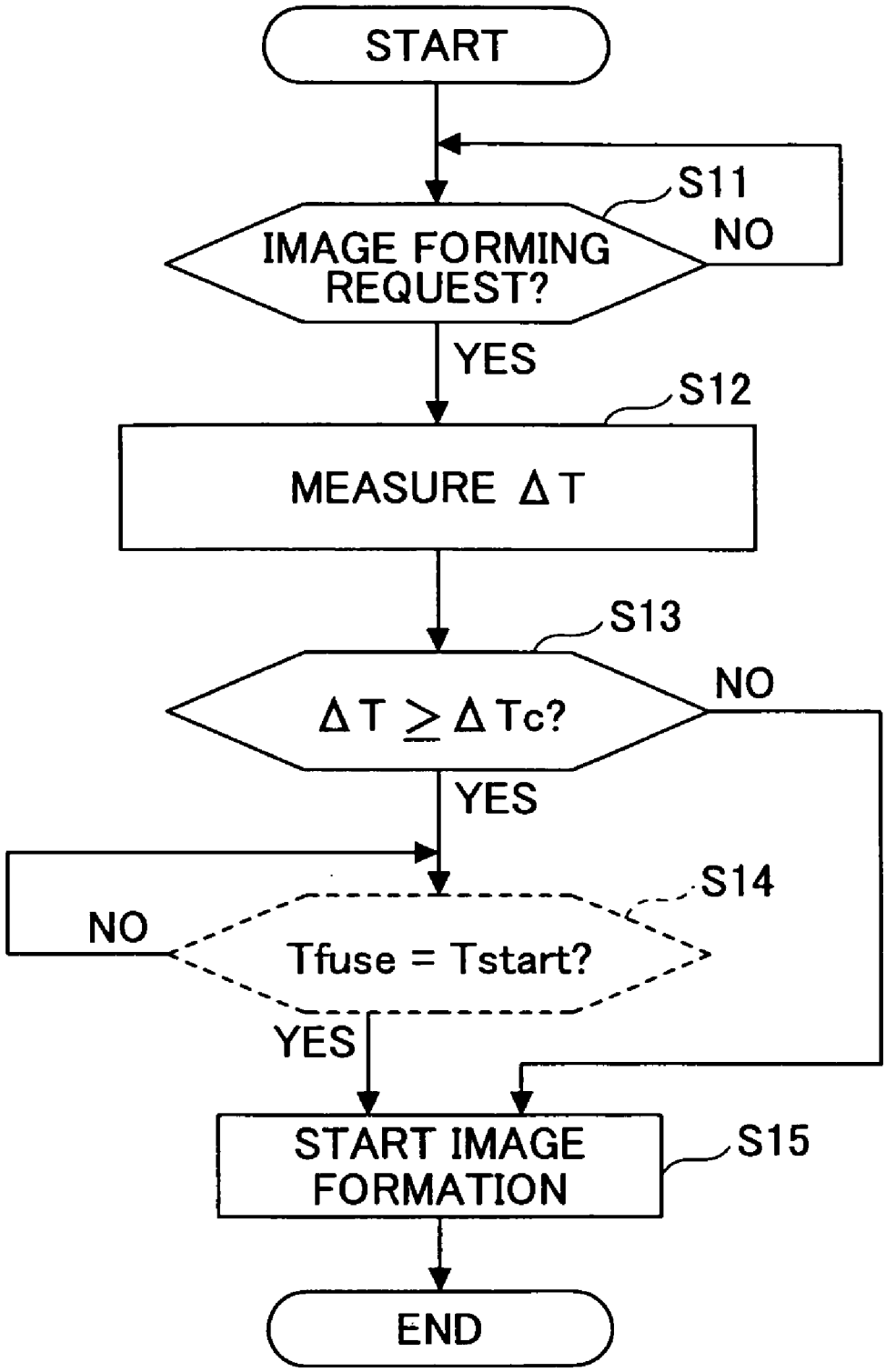
FIG. 11 shows a flowchart of an image formation process according to Embodiment 1.

FIG. 11 shows a flowchart of an image formation process according to Embodiment 2.

In Embodiment 2, as shown in FIG. 11, when the decrease amount ΔT of the temperature of the fusing roller surface is less than the threshold value ΔTc ("YES" in S13), the fusing roller is advance-rotated until the fusing roller surface temperature ("Tfuse") reaches an image formation start temperature ("Tstart") ("YES" in S14), whereupon image formation is started (S15). S11 and S12 are the same as S1 and S2 in FIG. 6.

Figure 12:
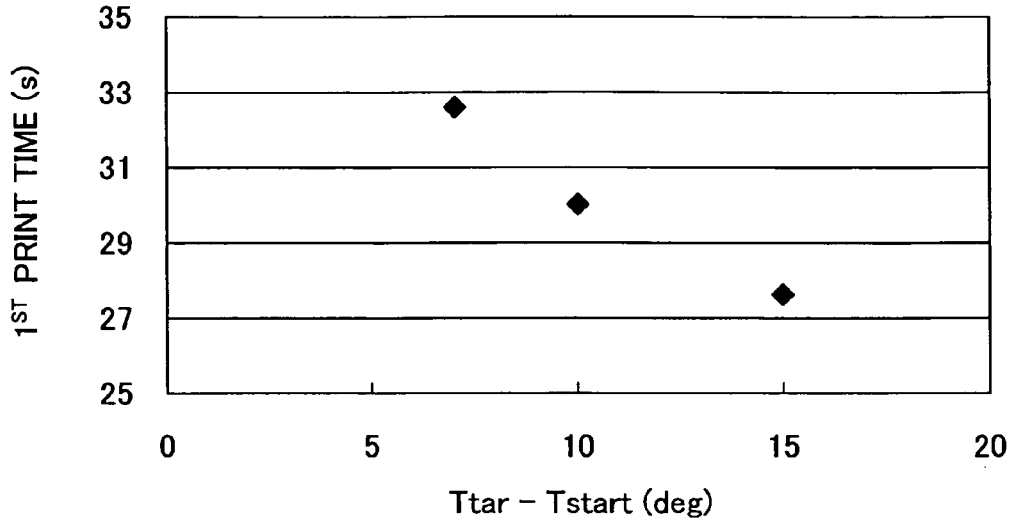
FIG. 12 shows a graph indicating the relationship between the first print time and the temperature difference between the image formation start temperature and the fusing target temperature.

In accordance with the present embodiment, the temperature difference between the image formation start temperature Tstart and the fusing target temperature ("Ttar") is set to 10 [deg]. As shown in FIG. 12, the greater the temperature difference between the image formation start temperature Tstart and the fusing target temperature Ttar, the more the first print time can be shortened. However, if the temperature difference between the image formation start temperature Tstart and the fusing target temperature Ttar is increased too much, the fusing lower-limit temperature ("Tdef") may not be reached before the time of fusing, thereby possibly resulting in a fusing defect.

Figure 13:
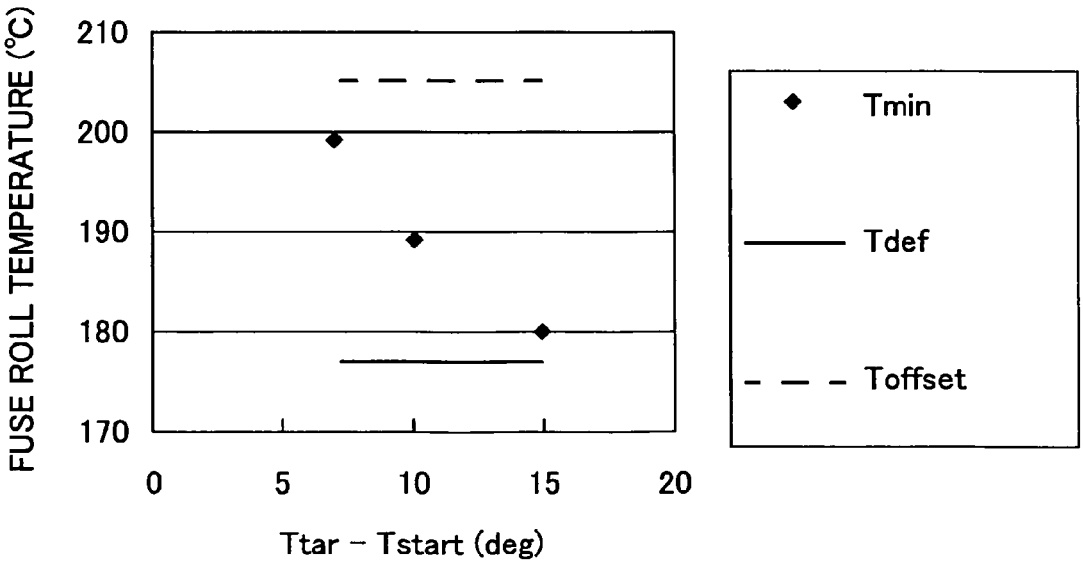
FIG. 13 shows a graph indicating the relationship between the minimum temperature of the fusing roller surface immediately before image formation, and the temperature difference between the image formation start temperature and the fusing target temperature.

FIG. 13 shows a case where the temperature difference between the image formation start temperature Tstart and the fusing target temperature Ttar is set between 5 to 15 [deg]. In this case, the temperature of the fusing roller surface at the time of fusing can be kept between a fusing upper-limit temperature ("Toffset"), above which a hot offset may occur, and the fusing lower-limit temperature Tdef, below which a fusing defect may occur. It is particularly preferable to set the temperature difference to be 10 [deg], where the minimum temperature Tmin of the fusing roller surface at the time of fusing can remain at roughly half between the fusing upper-limit temperature Toffset and the fusing lower-limit temperature Tdef, thus providing a large leeway against both a fusing defect and a hot offset.

Figure 14:
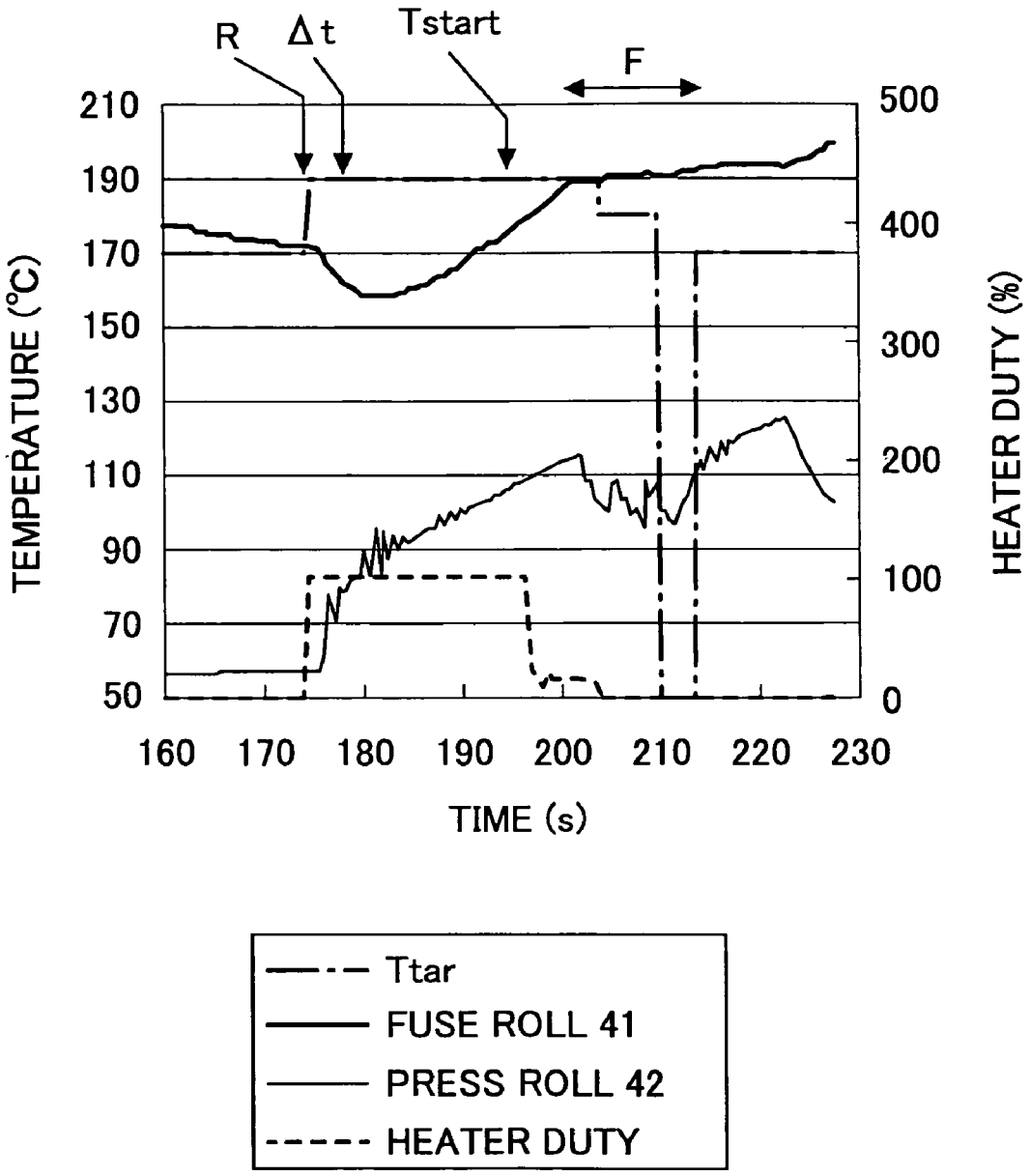
FIG. 14 shows a graph indicating the temporal change in the temperature of the fusing roller between the reception of an image formation request for continuous printing of three sheets and the start of an color image formation process according to Embodiment 2.

FIG. 14 shows a graph indicating the result of measuring the temperature of the fusing roller 41 before an image is fused on a transfer sheet in an image formation process according to Embodiment 2, when the temperature of the pressure roller 42 during standby was low. As shown, because the image formation was started after the image formation start temperature Tstart was reached, the temperature of the fusing roller surface substantially reached the fusing target temperature when the transfer sheet P passed the fusing nip F. As a result, a good image without fusing defects was obtained.

Figure 15:
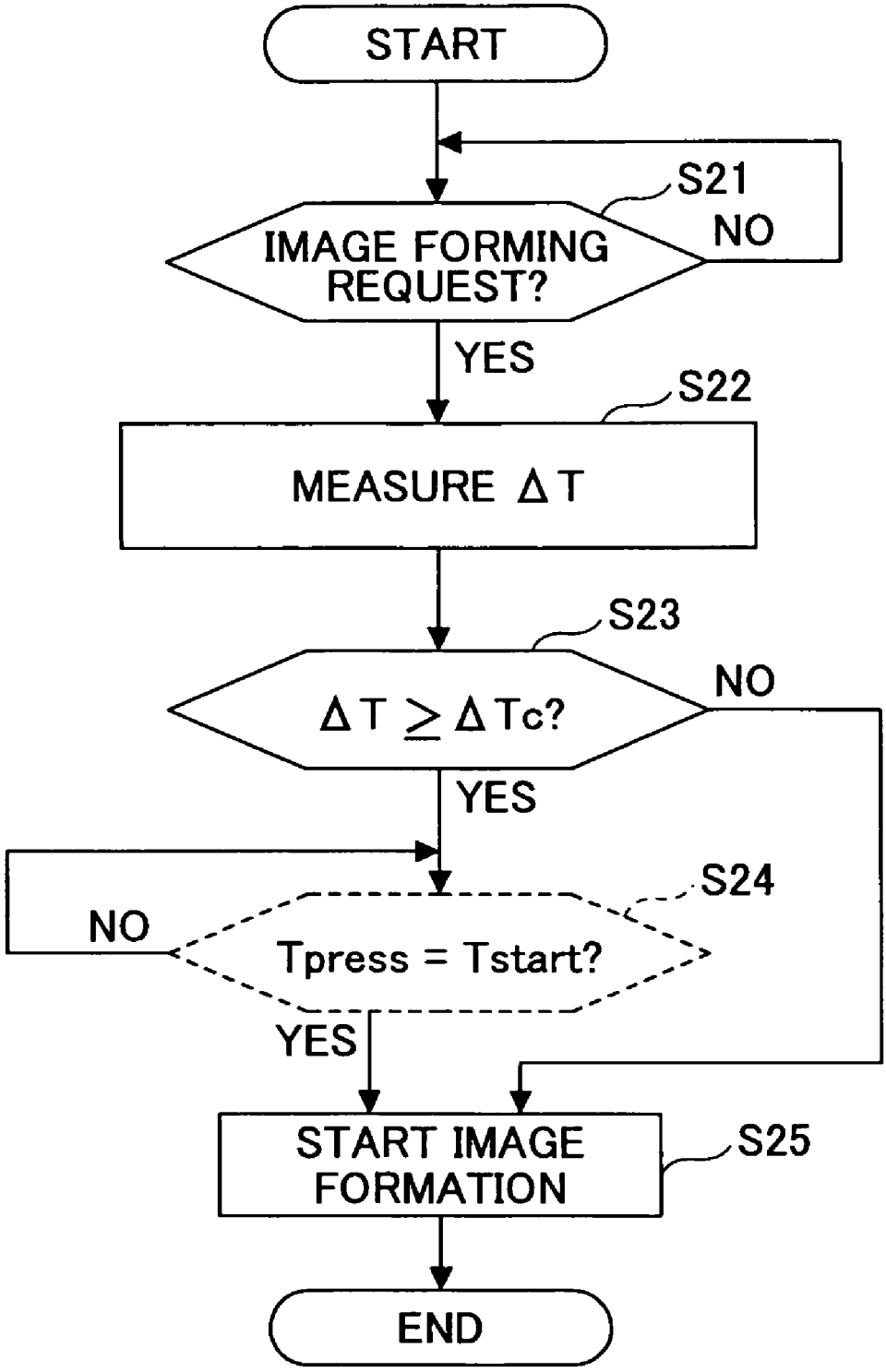
FIG. 15 shows a flowchart of an image formation process in which advance rotation is performed until the pressure roller reaches a pressure roller image formation start temperature.

FIG. 15 shows a flowchart of another embodiment in which a temperature sensor for detecting the temperature of the pressure roller surface is installed at the position indicated by the broken line in FIG. 3. In this embodiment, when the temperature of the pressure roller surface ("Tpress") reaches a pressure roller image formation start temperature ("YES" in S24), image formation is started (S25). S21, S22 and S23 are the same as S1-S3 in FIG. 6 or S11-13 in FIG. 11.

Embodiment 3

In Embodiment 3, a room temperature sensor, which is not shown, for detecting room temperature is provided to the device main body. Based on a result of detection by the room temperature sensor, it is determined whether the control according to Embodiment 1 or Embodiment 2 should be adopted.

Figure 16:
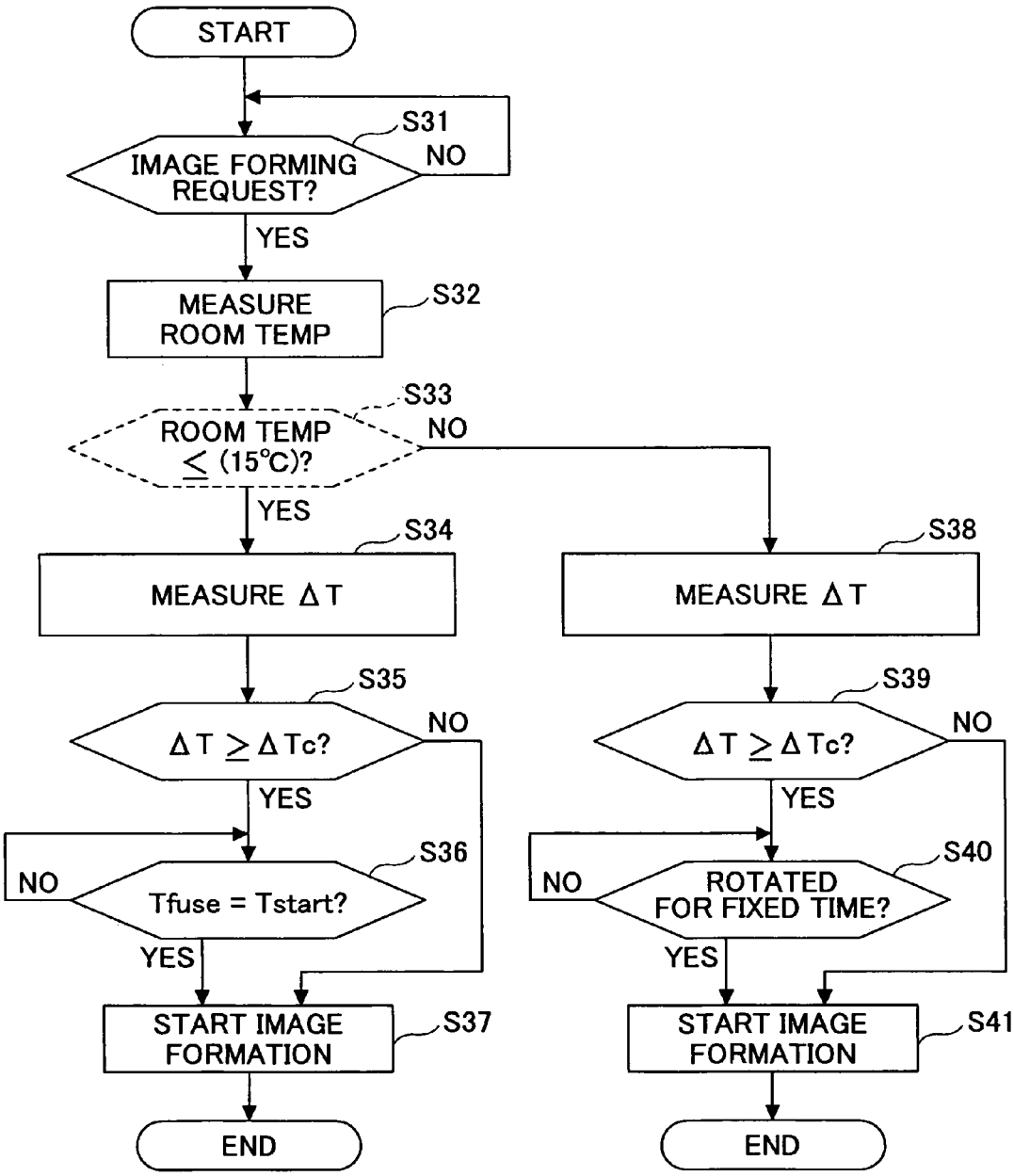
FIG. 16 shows a flowchart of an image formation process according to Embodiment 3.

FIG. 16 shows a flowchart of an image formation process according to Embodiment 3. As shown, upon reception of an image formation request ("YES" in S31), the control unit 200 detects the room temperature via the room temperature detect sensor not shown (S32). If the room temperature is not more than 15° C. ("YES" in S33), the temperature decrease amount ΔT is measured (S34). If the temperature decrease amount ΔT is equal to the threshold value or greater ("YES" in S35), the fusing roller is advance-rotated until its surface temperature Tfuse reaches the image formation start temperature Tstart ("YES" in S36), when image formation is started (S37).

On the other hand, if the room temperature exceeds 15.0 ("NO" in S33), the temperature decrease amount ΔT is measured (S38), and if the temperature decrease amount ΔT is greater than the threshold value ("YES" in S39), the fusing roller 41 is advance-rotated for a predetermined time (5 seconds) ("YES" in S40), and then image formation is started (S41).

Figure 17:
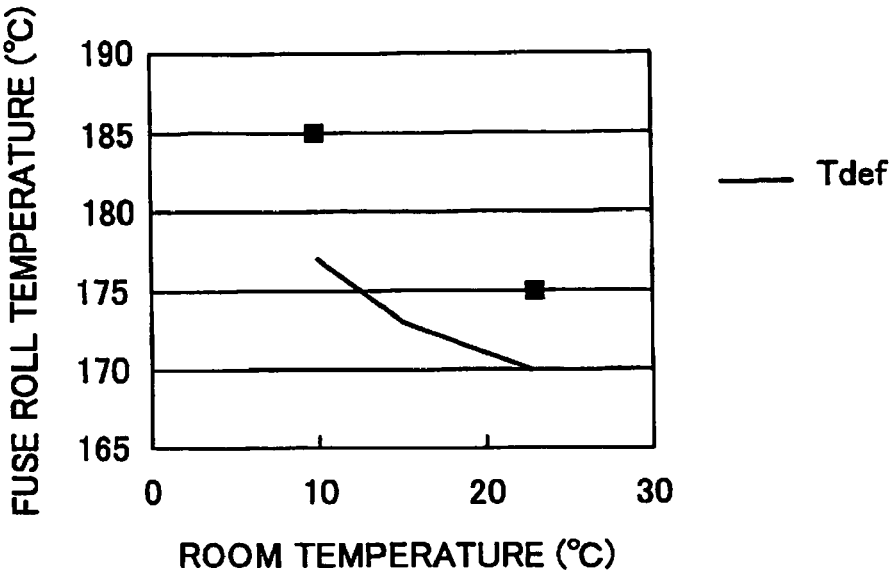
FIG. 17 shows a graph indicating the relationship between the minimum temperature of the fusing roller surface immediately before image formation and the room temperature.

FIG. 17 shows a graph indicating the fusing roller surface temperature at the time of fusing in accordance with Embodiment 3, and the fusing lower-limit temperature Tdef at individual room temperatures. As shown, when image formation was performed after the fusing roller 41 was advance-rotated for a predetermined time (5 seconds; i.e., as according to Embodiment 1), the surface temperature of the fusing roller 41 at the time of fusing was measured at 175° C. On the other hand, the surface temperature of the fusing roller 41 at the time of fusing was 185° C. in the case where advance rotation was performed until an image formation start temperature was reached (as according to Embodiment 2).

When the room temperature is low, the transfer sheet is also cold, so that the fusing lower-limit temperature Tdef to prevent fusing defect becomes higher. Since the fusing lower-limit temperature at the lower room temperature is 175° C. or higher, the 5 seconds advance rotation may not be enough for the surface temperature of the fusing roller to increase up to the fusing lower-limit temperature Tdef by the time the transfer sheet passes the fusing nip, thus possibly resulting in a fusing defect. Therefore, when room temperature is low, advance rotation is performed until the fusing roller surface temperature reaches the image formation start temperature before the start of image formation.

When the room temperature is high, the fusing lower-limit temperature is lower, so that the temperature of the fusing roller surface at the time of fusing can reach the fusing lower-limit temperature or above by rotating the fusing roller for a predetermined time (such as 5 seconds; as according to Embodiment 1).

Figure 18:
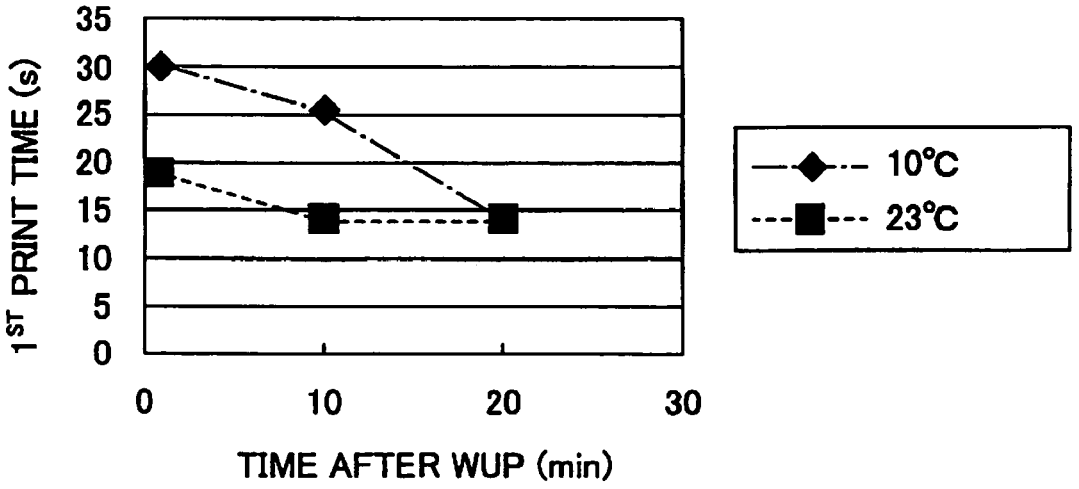
FIG. 18 shows a graph indicating changes in the first print time.

As shown in FIG. 18, in a low room temperature environment of 10° C., in order to prevent fusing defects, advance rotation is performed until the image formation start temperature is reached, resulting in a longer first print time immediately after warm-up. When the room temperature is 23° C., advance rotation is performed only for the predetermined time (5 seconds), so that the first print time is shorter immediately after warm-up. Thus, the first print time immediately after warm-up can be reduced in an office environment, for example, where room temperature is maintained at a predetermined temperature or above.

Alternatively, the advance rotation time may be varied depending on the room temperature when the room temperature is below a certain temperature. In this way, the first print time immediately after warm-up can be reduced flexibly in a low-temperature office environment, and the development of fusing defect can be prevented.

In another embodiment, when the room temperature is above a certain temperature, the difference between the image formation start temperature and the fusing target temperature may be varied depending on the room temperature. In this way, the first print time can be reduced and fusing defects can be prevented in a high-temperature office environment.

Embodiment 4

In Embodiment 4, when the decrease amount ΔT of the temperature of the fusing roller surface is lower than the threshold value ΔTc, the fusing target temperature and the standby target temperature are increased. In addition, a follow-up rotation, which is performed after fusing to prevent the surface temperature of the fusing roller from becoming too high, is extended.

Figure 19:
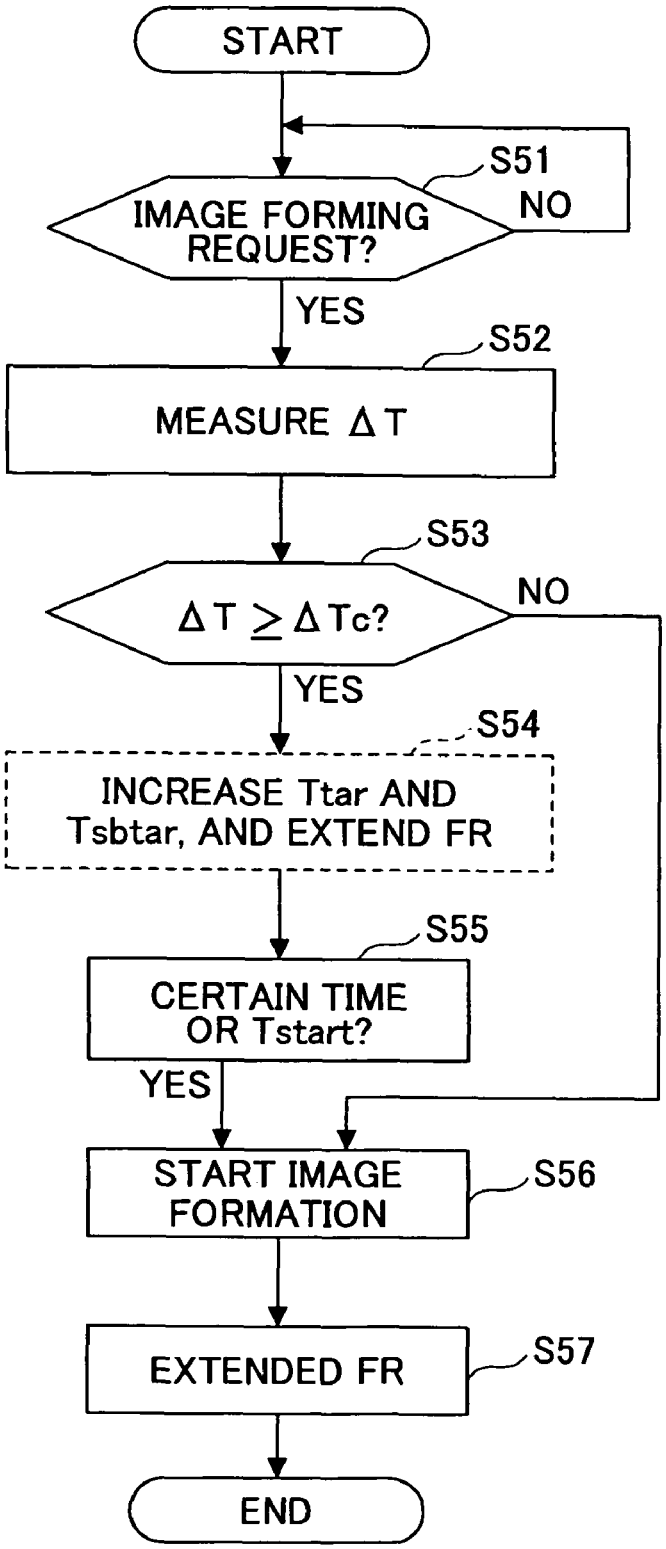
FIG. 19 shows a flowchart of an image formation process according to Embodiment 4.

FIG. 19 shows a flowchart of an image formation process according to Embodiment 4. As shown, when the decrease amount ΔT of the temperature of the fusing roller surface is the threshold value ΔTc or higher ("YES" in S53), a predetermined temperature is added to each of the fusing target temperature Ttar and the standby target temperature ("Tsbtar"). In addition, the follow-up rotation after fusing is extended by a predetermined time (S54). Then, the fusing roller 41 is advance-rotated for a predetermined time or until its temperature reaches an image formation start temperature Tstart (S55), and then the image formation operation is started (S56). After the image formation operation, the follow-up rotation ("FR") of the fusing roller pair is performed for an extended time (S57). Thereafter, the fusing target temperature Ttar and the extended follow-up rotation time are brought back to their normal values, and the standby target time is brought back to its normal value upon a next image formation request. S51 and S52 are the same as S1-S2 in FIG. 6, S11-S12 in FIG. 11, S21-S22 in FIG. 15.

On the other hand, when the decrease amount ΔT of the temperature of the fusing roller surface is smaller than the threshold value ΔTc ("NO" in S53), the image formation operation is started without increasing the fusing target temperature or the standby target temperature and without extending the follow-up rotation.

In the present embodiment, the fusing target temperature is 10° C., the standby target temperature is increased by 10° C., and the follow-up rotation operation is extended by 10 seconds. However, these values may be determined as required depending on the device structure. Depending on the device structure, the follow-up rotation may normally not performed and may be performed only when the decrease amount ΔT of the temperature of the fusing roller surface is less than the threshold value ΔTc.

Figure 20:
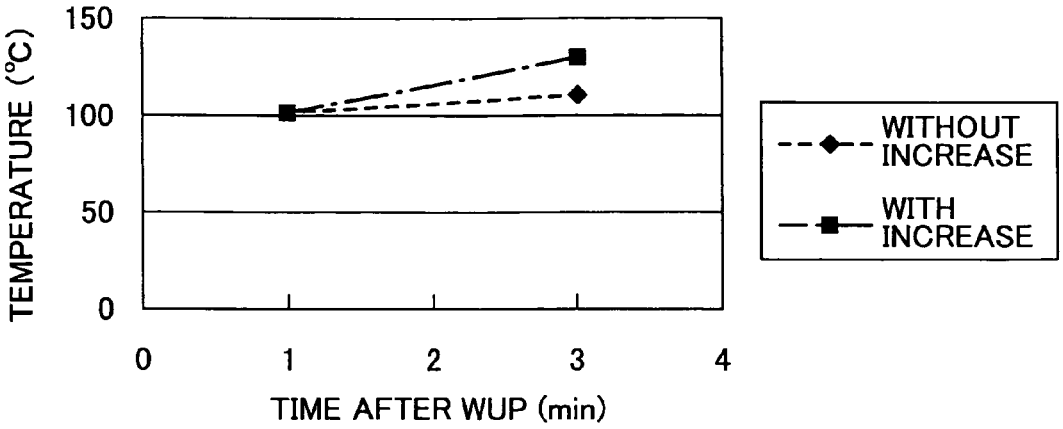
FIG. 20 shows a graph indicating changes in the temperature of the pressure roller.
Figure 21:
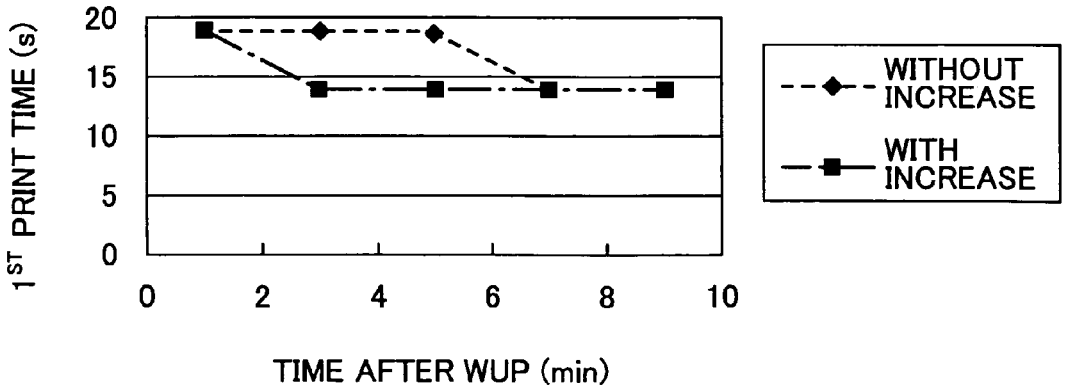
FIG. 21 shows a graph indicating changes in the first print time.

Thus, when the decrease amount ΔT of the temperature of the fusing roller surface is smaller than the threshold value ΔTc, the fusing target temperature and the standby target temperature are increased, and the follow-up rotation time after fusing is extended. In this way, as shown in FIG. 20, the increase in the temperature of the pressure roller 42 after performing the image formation operation immediately after warm-up becomes greater. This is due to the fact that the pressure roller 42 was actively heated by the increase in the fusing target temperature or the standby target temperature and the extension of the follow-up rotation operation.

By thus actively heating the pressure roller 42, the decrease amount of the fusing roller surface temperature in the second image formation operation becomes smaller than the threshold value. Thus, the need for the advance rotation is eliminated, and the number of sheets in which the first print time is extended can be reduced.

In the case of a continuous print operation, when the decrease amount ΔT of the temperature of the fusing roller surface is equal to or greater than the threshold value ΔTc, the continuous print proceeds with a fusing target temperature higher than normal. Because the heat of the pressure roller 42 is taken away by the transfer sheet as the transfer sheet passes the fusing nip, the temperature difference between the fusing roller 41 and the pressure roller 42 increases as the continuous printing proceeds. In addition, when the continuous print is performed at the higher-than-normal fusing target temperature, the temperature difference between the fusing roller 41 and the pressure roller 42 becomes greater than normal. As a result, the rate of expansion/contraction of the sheet varies between its top and bottom surfaces, resulting in a large amount of curl in the transfer sheet towards the latter half of the continuous print. As the amount of curl in the transfer sheet increases, the stacking property may deteriorate, resulting in problems such as a page mixup or the fall of the transfer sheet out of the sheet ejection tray.

Figure 22:
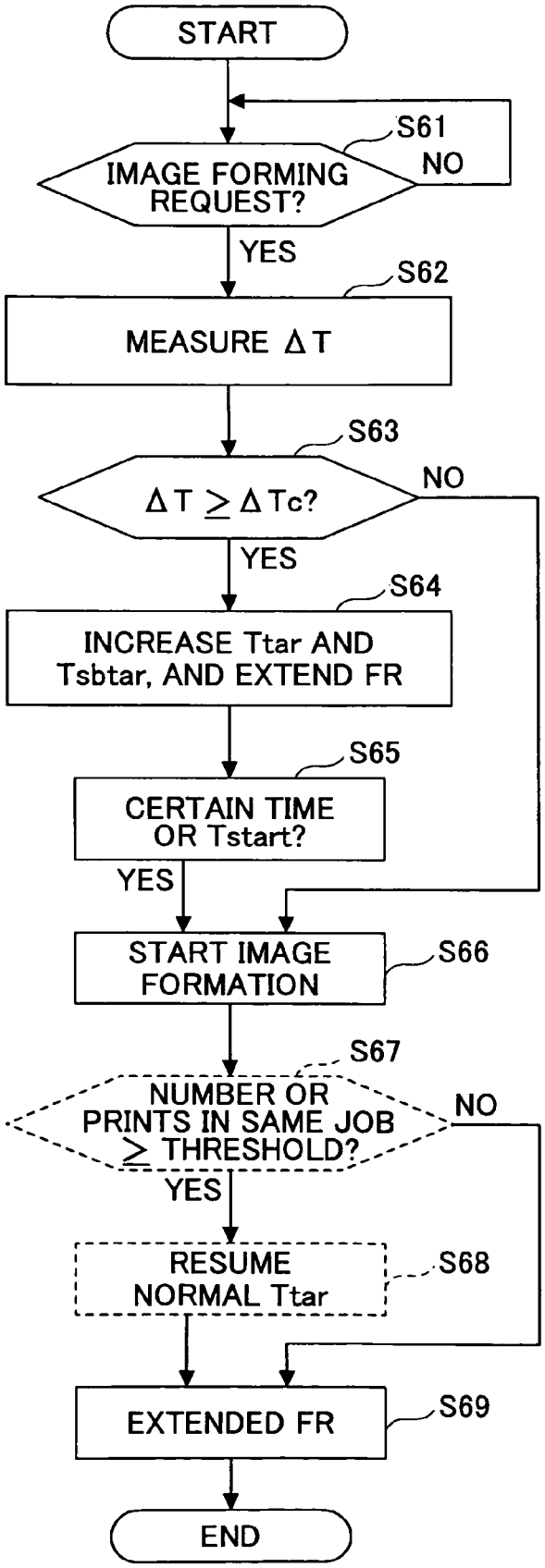
FIG. 22 shows a flowchart of an image formation process in which a normal fusing target temperature is resumed when the number of continuous print sheets exceeds a threshold value.

Thus, as shown in a flowchart of FIG. 22, when the decrease amount ΔT of the temperature of the fusing roller surface is equal to or greater than the threshold value ΔTc ("YES" in S63), a predetermined temperature is added to each of the fusing target temperature and the standby target temperature, and the follow-up rotation FR after fusing is extended by a predetermined time (S64). After a predetermined time or the image formation start temperature is reached (S65), an image formation operation is started (S66), which is followed by counting the number of printed sheets in the same job. When the print number exceeds a threshold value ("YES" in S67), the normal fusing target temperature without the aforementioned added temperature is resumed (S68), followed by printing the remaining sheets. S61, S62 and S69 are the same as S51-S52 and S57 in FIG. 19.

FIG. 23 shows the result of visually inspecting how the printed sheets of a T6200 paper were stacked when continuously printed by the flow of FIG. 19 and by the flow of FIG. 22. In the case of the flow of FIG. 19, the amount of curl in the transfer sheet increased in the latter half of the continuous print process, resulting in a stack defect. On the other hand, by performing the flow of FIG. 22, the amount of curl in the transfer sheet in the latter half of the continuous print was maintained below a certain level, and no stack defect was caused.

Embodiment 5

In Embodiment 5, in order to reduce the curl in the transfer sheet, the humidity of the room is detected with a humidity sensor, and the advance rotation time is extended depending on the humidity.

Figure 24:
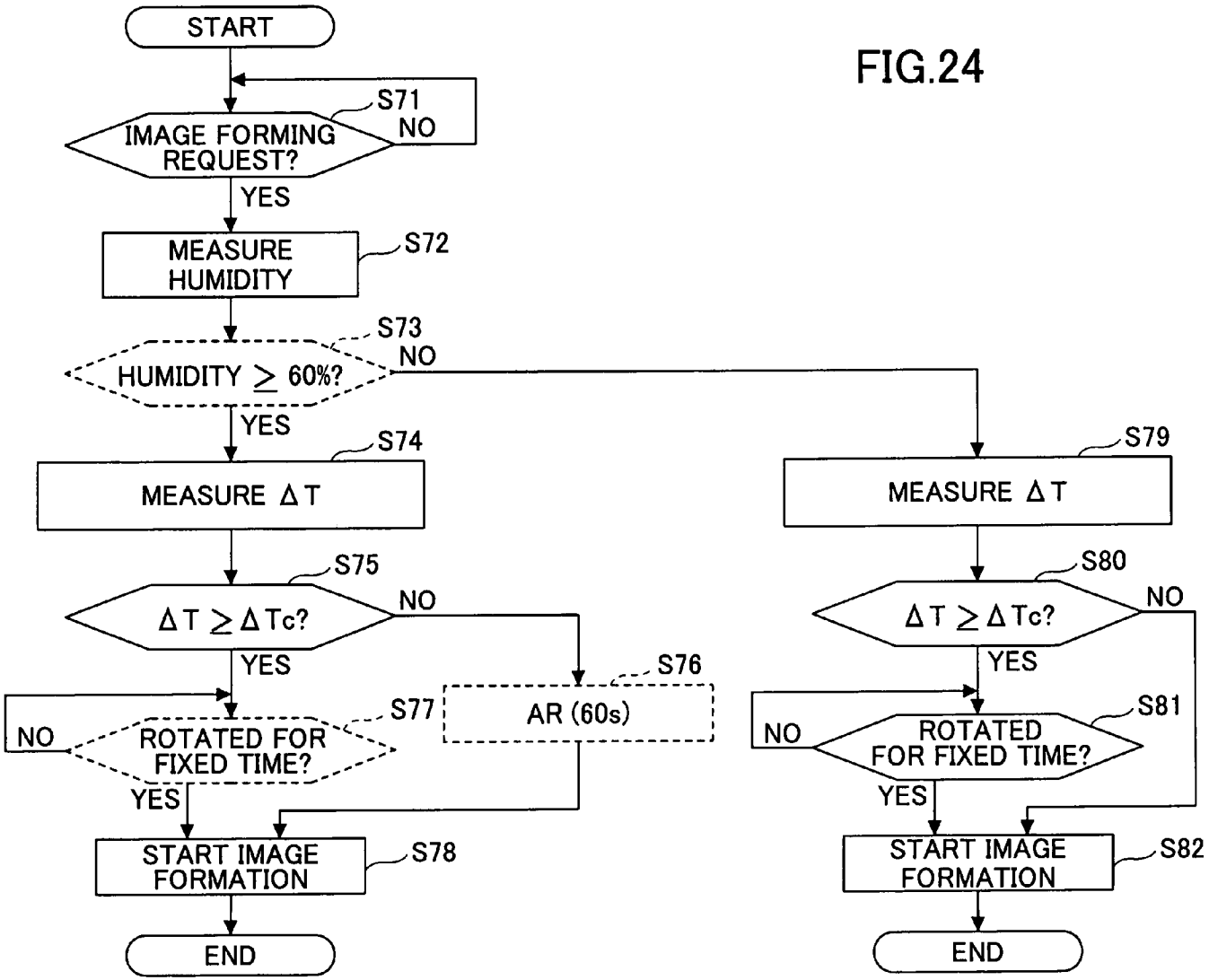
FIG. 24 shows a flowchart of an image formation process according to Embodiment 5.

FIG. 24 shows a flowchart of an image formation process according to Embodiment 5. As shown, when the room humidity detected with the humidity sensor (S72) is 60% or greater ("YES" in S73), and when the temperature decrease amount ΔT is equal to or greater than the threshold value ΔTc ("YES" in S75), a predetermined time of advance rotation is performed and an additional 60 seconds of rotation is performed (S77). Then, an image formation operation is started (S78). Also, when the room humidity is 60% or greater ("YES" in S73), and when the temperature decrease amount ΔT is smaller than the threshold value ΔTc ("NO" in S75), image formation is started (S78) after a 60-seconds advance rotation (S76). S71 and S74 are the same as S31 and S34 in FIG. 16.

On the other hand, when the room humidity is less than 60% ("NO" in S73), the same control as in Embodiment 1 is performed (S79 to S82).

Figure 25:
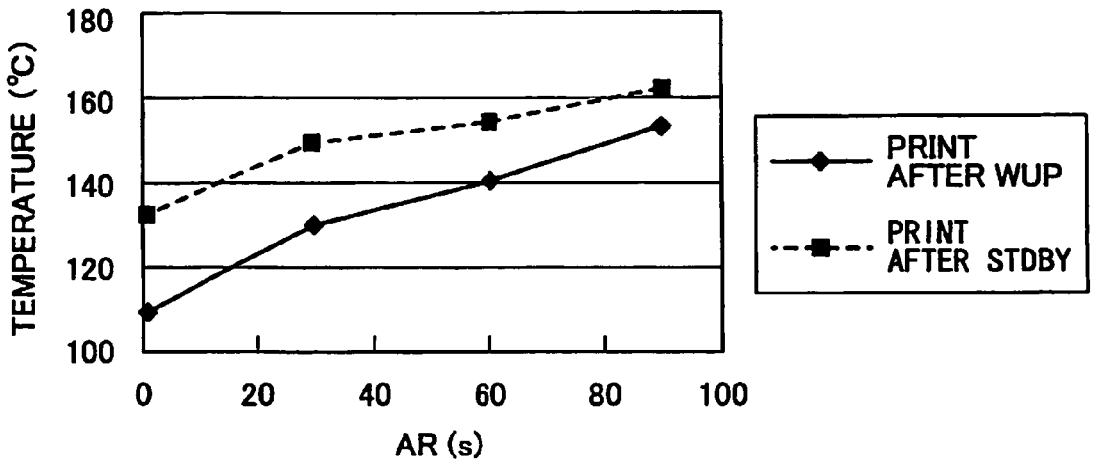
FIG. 25 shows a graph indicating the relationship between the temperature of the pressure roller surface immediately before image formation and the advance rotation time.
Figure 26:
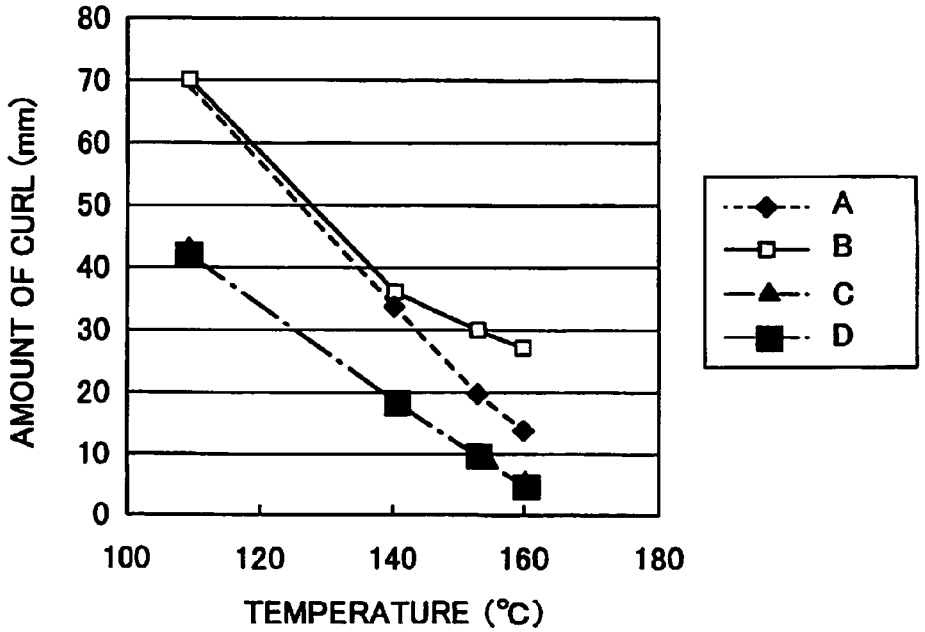
FIG. 26 shows a graph indicating the relationship between the amount of curl in the transfer sheet immediately in the case of image formation immediately after warm-up and the pressure roller surface temperature immediately before image formation.

FIG. 25 shows a graph indicating the advance rotation time and the surface temperature of the pressure roller after advance rotation. FIG. 26 shows a graph indicating the relationship between the surface temperature of the pressure roller after advance rotation and the amount of curl in the transfer sheet when image formation was performed immediately after warm-up, in an environment of temperature 27° C. and humidity 90%.

As shown in FIG. 26, when the surface temperature of the pressure roller after advance rotation is about 140° C., the amount of curl in the transfer sheet can be kept less than 40 mm regardless of the sheet type A-D. It is seen from FIG. 25 that an advance rotation of 60 seconds is required in order to make the temperature of the pressure roller 140° C.

Figures 27, 28:
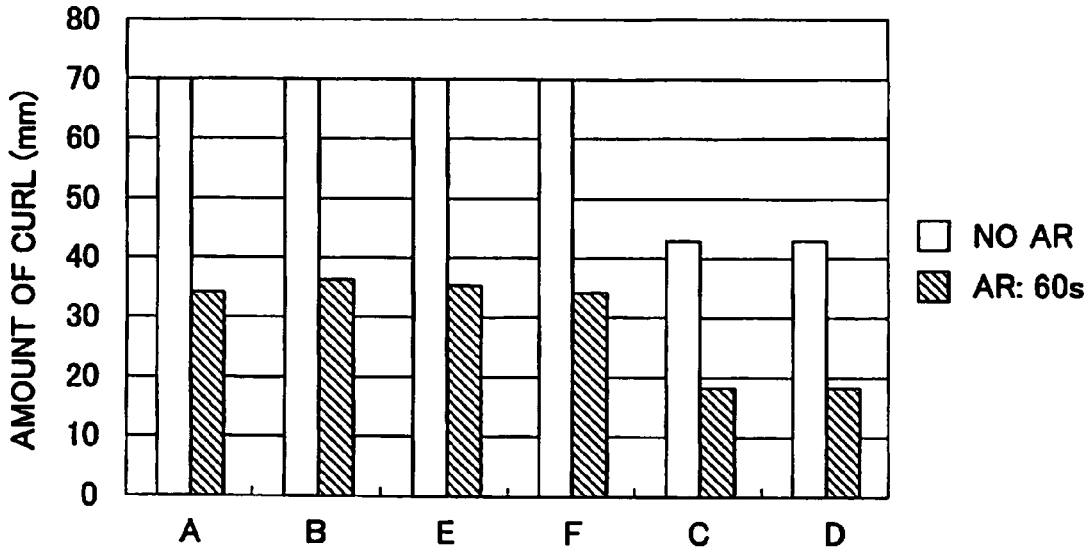
FIG. 27 shows a graph indicating the amount of curl when advance rotation was performed and when advance rotation was not performed.
FIG. 28 indicates a relationship between humidity conditions and the advance rotation time.

FIG. 27 shows a graph indicating the result of measuring the amount of curl when the control according to Embodiment 5 was performed ("AR"), and when a 60-seconds advance rotation operation was not performed ("No AR"). As shown, in accordance with Embodiment 5, the amount of curl was kept to less than 40 mm in all types of paper A-F.

While in the foregoing embodiment, when the humidity is 60% or greater, a uniform 60 seconds advance rotation operation is performed, the advance rotation time AR may be 30 seconds when the humidity is 60 to 79% and 60 seconds when the humidity is 80% or greater as shown in FIG. 28.

Figure 29:
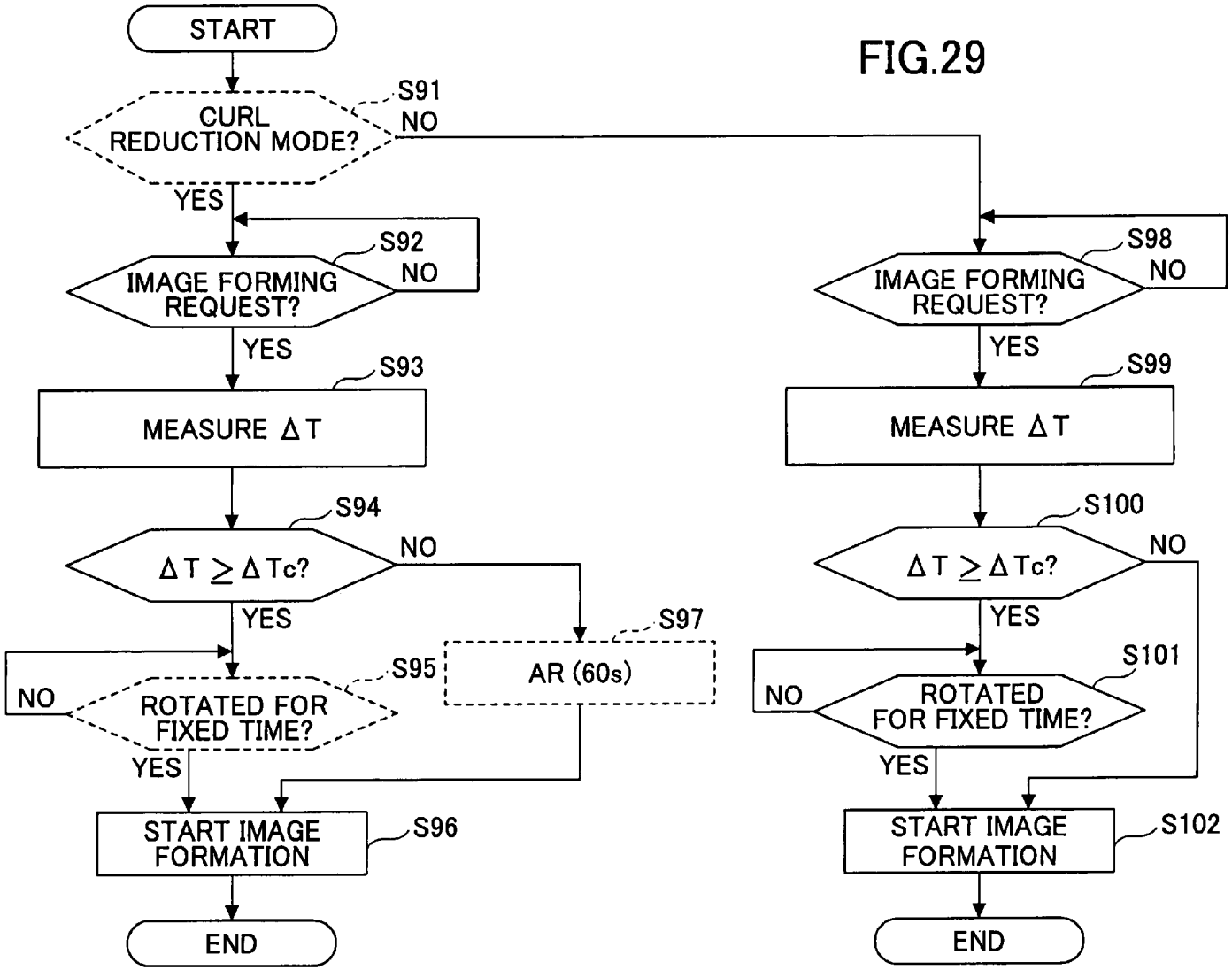
FIG. 29 shows a flowchart of an image formation process when a curl reduction mode is provided.

Even when the humidity low, if the temperature difference between the pressure roller and the fusing roller is large, the amount of curl may become large depending on the type of paper. In such a case, as shown in FIG. 29, when the user sets a curl reduction mode using a personal computer or a control unit on a printer ("YES" in S91), an advance rotation for curl reduction may be performed in advance regardless of the room humidity. S92-S102 are the same as S71, S74-S78, S71, S79-S82, respectively, in FIG. 24.

Alternatively, as shown in FIG. 30, there may be provided two kinds of curl reduction mode, such as a light curl reduction mode that performs a 30 seconds advance rotation, and a heavy curl reduction mode for performing a 60 seconds advance rotation. Either of these modes may be selected by the user depending on the type of paper.

Figure 31:
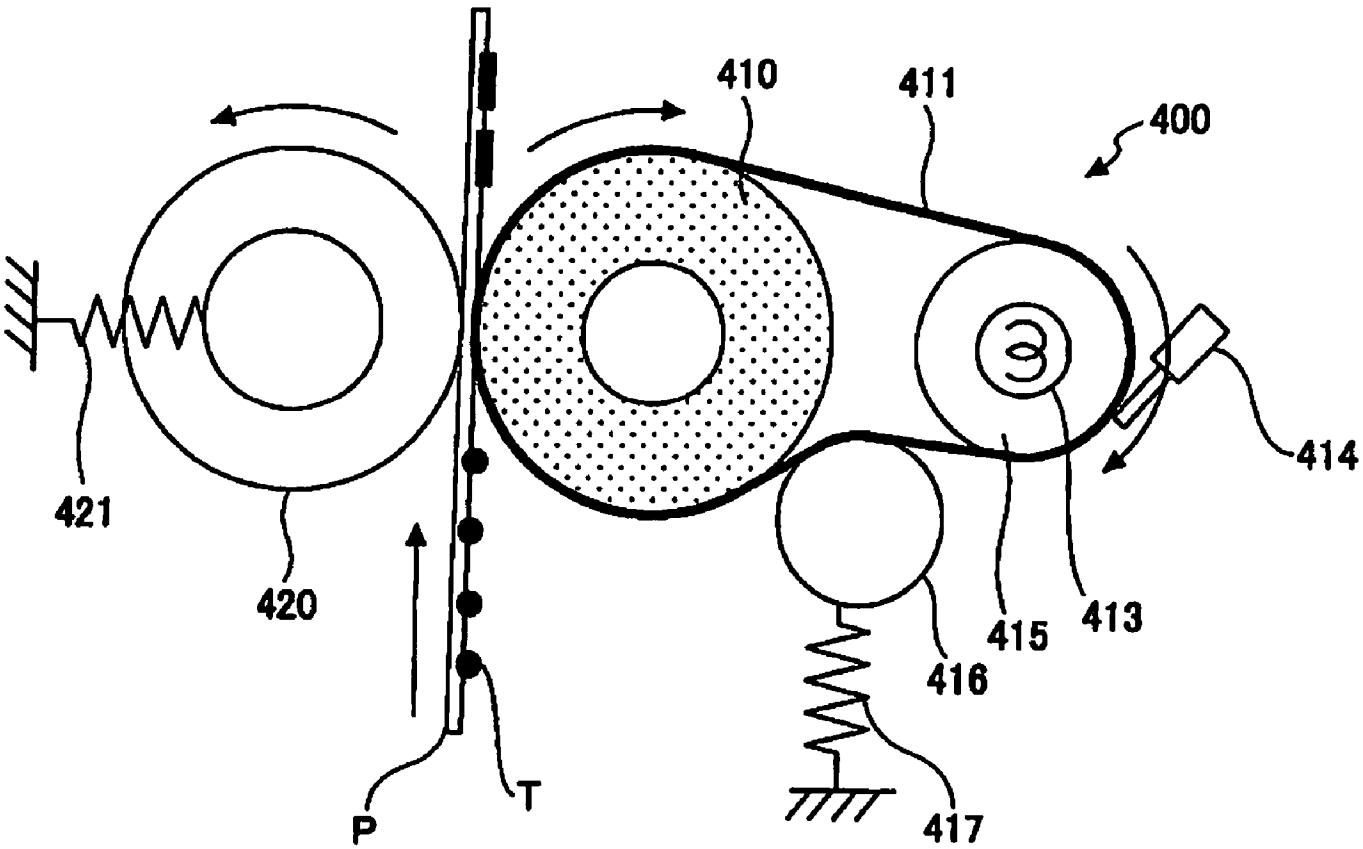
FIG. 31 shows a schematic diagram of a belt-type fusing device.

The present invention may be embodied in a belt-type fusing device. FIG. 31 shows a schematic diagram of a belt-type fusing device 400. The fusing device 400 includes a fusing rotating body pair of a resilient roller 410 and a pressure roller 420.

The resilient roller 410 includes a spongy resilient layer. The pressure roller 420 is a pressure rotating body disposed opposite the resilient roller 410 via a fusing belt 411, which is a fusing rotating body. The pressure roller 420 has a higher hardness than the resilient roller 410.

As shown in FIG. 31, in the fusing device 400, the endless fusing belt 411 is extended between a heating roller 415 and the resilient roller 410 as plural extension members.

The heating roller 415 has a metal core in which a heating member 413, such as a halogen lamp, is contained. By the heat radiated by the heating member 413, the fusing belt 411 is heated from the inside. At a position opposite the resilient roller 410 via the fusing belt 411, there is disposed a temperature sensor 414. Based on a temperature detected by the temperature sensor 414, the heating member 413 is controlled to have a fusing target temperature.

The pressure roller 420 presses the resilient roller 410 via the fusing belt 411. The pressure roller 420 is rotated by a fusing motor via a wire 421 so that the resilient roller 410 can be driven and rotated. The fusing device 400 also includes a tensioning roller 416 that contacts the fusing belt 411 approximately in the middle thereof. The tensioning roller 416 biases the belt towards the inside by the force of a spring 417, thereby tensioning the fusing belt 411. The fusing motor may be provided to the resilient roller 410 so that the pressure roller 420 can be driven to rotate.

In this belt-type fusing device 400, the transfer sheet P is passed between the fusing belt 411, which is heated by the heating roller 415, and the pressure roller 420. As a result, a toner image T attached unfused on the surface of the transfer sheet P is softened by the heat from the fusing belt 411 and fused onto the transfer sheet while being pressed by the pressure roller 420. Because of the use of the belt, the temperature of the fusing roller surface can be raised to the fusing target temperature in a warm-up operation of less than 60 seconds.

The present invention is not limited to a color image forming apparatus of the intermediate transfer tandem type but may also be applied to a color image forming apparatus of a direct transfer tandem type.

Thus, the image forming apparatus of the foregoing embodiment includes a toner image formation unit configured to form a toner image on a photosensitive body as an image carrier; a transfer unit configured to transfer the toner image on the photosensitive body onto a transfer sheet as a recording medium; a fusing roller that is a fusing rotating body that is heated by a heating unit; a pressure roller as a pressure rotating body that contacts the fusing roller to form a fusing nip between the pressure roller and the fusing roller, the fusing roller and the pressure roller forming a fusing roller pair; and a fusing device configured to pass the transfer sheet through the fusing nip in order to fuse the toner image onto the transfer sheet using heat and pressure.

The apparatus also includes a temperature sensor which is a temperature detecting unit configured to detect the temperature on the surface of the fusing roller. There is also provided a control unit which, in response to an image formation request, causes the fusing roller pair to be rotated. The decrease amount $\Delta T$ of the temperature of the fusing roller surface is detected by the temperature sensor at a time $\Delta t$. When the temperature decrease amount $\Delta T$ is greater than a threshold value, the control unit extends the time before the transfer sheet with the toner image formed thereon arrives at the fusing/nipping portion.

Thus, even in the case of a fusing roller with a high thermal responsiveness such that the fusing roller surface temperature can be raised to a fusing target temperature in a warm-up operation of less than 60 seconds, it can be accurately determined whether to extend the time or not to prevent fusing defects. Because the time is extended only when the temperature decrease amount is greater than a threshold value, the first print time can be reduced compared with the case where the time is extended regardless of the temperature decrease amount.

By delaying the start of forming the toner image on the image carrier, the time can be extended before the recording medium with the toner image formed thereon arrives at the fusing/nipping portion.

In accordance with Embodiment 2, the control unit is configured to start the formation of a toner image on a photosensitive body when the fusing roller or the pressure roller reaches a image formation start temperature. Thus, the surface temperature of the fusing roller can substantially reach the fusing target temperature upon arrival of the transfer sheet at the fusing nip, so that fusing defect can be prevented.

In accordance with Embodiment 3, based on a detect result from a room temperature sensor as a room temperature detecting unit that detects room temperature, the control unit is configured to determine whether the formation of a toner image on the photosensitive body should be started after a predetermined time or upon the fusing roller or the pressure roller reaching an image formation start temperature. In this way, an optimum control can be exerted depending on room temperature.

Particularly, when the room temperature is 15° C. or lower, the formation of the toner image on the photosensitive body is started when the fusing roller or the pressure roller reaches a predetermined temperature. When the room temperature exceeds 15° C., the control unit selects the option of forming the toner image on the photosensitive body after a predetermined time. In this way, the following advantageous effects can be obtained. Namely, when the room temperature is low at 15° C. or below, by performing an advance rotation until the fusing roller or the pressure roller reaches the predetermined temperature, the surface temperature of the fusing roller can be reliably raised to the fusing lower-limit temperature or above where no fusing defects are caused upon fusing. When the room temperature exceeds 15° C., because the fusing lower-limit temperature decreases, so that no fusing defects are caused even when the temperature of the fusing roller surface drops below the fusing target temperature to some extent. Thus, when the room temperature exceeds 15° C., image formation is started after a predetermined time of advance rotation, whereby fusing defect can be prevented and the first print time can be reduced.

In accordance with Embodiment 4, when the temperature decrease amount is greater than a threshold value, the fusing target temperature is raised above normal by the control unit. In this way, the pressure roller can be heated in less time, the number of sheets in which advance rotation is performed can be reduced, and the number of sheets in which the first print time is extended can be reduced.

When the number of sheets in which continuous image formation is performed exceeds a threshold value, a normal fusing target temperature may be resumed by the control unit. In this way, the development of curl in the transfer sheet in the latter half of the continuous image formation process can be prevented, whereby stack defect can be prevented.

When the temperature decrease amount is greater than a threshold value, the heating of the pressure roller can also be quickened by configuring the control unit so that, after the toner image is fused onto the transfer sheet, the fusing rotating body pair is subjected to a certain duration of follow-up rotation. In this way, the number of sheets in which advance rotation is performed can be reduced, and also the number of sheets in which the first print time is extended can be reduced.

When the temperature decrease amount is greater than a threshold value, the standby target temperature may be raised above normal by the control unit. In this way, the heating of the pressure roller can also be quickened, whereby the number of sheets in which advance rotation is performed can be reduced, and also the number of sheets in which the first print time is extended can be reduced.

In accordance with Embodiment 5, there is provided a humidity sensor as a humidity detecting unit that detects room humidity. When the room humidity is higher than a threshold value, the fusing roller pair is advance-rotated by the control unit. In this way, the temperature difference between the fusing roller and the pressure roller can be reduced, and the curling in the transfer sheet can be prevented.

The control unit may be configured so that the user is allowed to select whether or not to perform the advance rotation of the fusing roller pair, using a personal computer or a control unit on a printer, for example. In this way, when using a transfer sheet that tends to develop a curl, the user may select to rotate the fusing roller pair in advance to prevent the curling of the transfer sheet. When the transfer sheet does not easily produce a curl, the user may select not to perform advance rotation, whereby the first print time can be reduced.

Although this invention has been described in detail with reference to certain embodiments, variations and modifications exist within the scope and spirit of the invention as described and defined in the following claims.

The present application is based on the Japanese Priority Application No. 2007-284260 filed Oct. 31, 2007, the entire contents of which are hereby incorporated by reference.

What is claimed is:

1. An image forming apparatus comprising:

an image forming unit configured to form a toner image on an image carrier;

a transfer unit configured to transfer the toner image on the image carrier to a recording medium;

a fusing rotating body that is heated by a heating unit;

a pressure rotating body that contacts the fusing rotating body to form a fusing/nipping portion between the fusing rotating body and the pressure rotating body, the fusing rotating body and the pressure rotating body forming a fusing rotating body pair;

a fusing device configured to cause the recording medium to pass through the fusing/nipping portion and configured to fuse the toner image on the recording medium onto the recording medium;

a temperature detecting unit configured to detect a temperature on a surface of the fusing rotating body;

a control unit configured to cause the fusing rotating body pair to be rotated in response to an image formation request, detect an amount of decrease in the temperature of the fusing rotating body surface at a predetermined time with the temperature detecting unit, and extend a time between the image formation request and an arrival of the recording medium with the toner image formed thereon at the fusing/nipping portion when the temperature decrease amount is greater than a threshold value; and wherein the control unit is configured to allow a user to select whether the time before the recording medium with the toner image formed thereon arrives at the fusing/nipping portion should be extended, using an operating unit with which the user can enter an instruction into the apparatus.

2. An image forming apparatus comprising:

an image forming unit configured to form a toner image on an image carrier;

a transfer unit configured to transfer the toner image on the image carrier to a recording medium;

a fusing rotating body that is heated by a heating unit;

a pressure rotating body that contacts the fusing rotating body to form a fusing/nipping portion between the fusing rotating body and the pressure rotating body, the fusing rotating body and the pressure rotating body forming a fusing rotating body pair;

a fusing device configured to cause the recording medium to pass through the fusing/nipping portion and configured to fuse the toner image on the recording medium onto the recording medium;

a temperature detecting unit configured to detect a temperature on a surface of the fusing rotating body;

a control unit configured to cause the fusing rotating body pair to be rotated in response to an image formation request, detect an amount of decrease in the temperature of the fusing rotating body surface at a predetermined time with the temperature detecting unit, and extend a time between the image formation request and an arrival of the recording medium with the toner image formed thereon at the fusing/nipping portion when the temperature decrease amount is greater than a threshold value; and wherein the control unit is configured to raise a fusing target temperature, which is a target in controlling a heating amount of the heating unit when the toner image is fused on the recording medium, to a fusing target temperature higher than normal, when the temperature decrease amount is greater than the threshold value.

3. The image forming apparatus according to claim 2, wherein the control unit is configured to resume a normal fusing target temperature when a number of sheets for continuous image formation exceeds a threshold value.

4. An image forming apparatus comprising:

an image forming unit configured to form a toner image on an image carrier;

a transfer unit configured to transfer the toner image on the image carrier to a recording medium;

a fusing rotating body that is heated by a heating unit;

a pressure rotating body that contacts the fusing rotating body to form a fusing/nipping portion between the fusing rotating body and the pressure rotating body, the fusing rotating body and the pressure rotating body forming a fusing rotating body pair;

a fusing device configured to cause the recording medium to pass through the fusing/nipping portion and configured to fuse the toner image on the recording medium onto the recording medium;

a temperature detecting unit configured to detect a temperature on a surface of the fusing rotating body;

a control unit configured to cause the fusing rotating body pair to be rotated in response to an image formation request, detect an amount of decrease in the temperature of the fusing rotating body surface at a predetermined time with the temperature detecting unit, and extend a time between the image formation request and an arrival of the recording medium with the toner image formed thereon at the fusing/nipping portion when the temperature decrease amount is greater than a threshold value; and wherein the control unit is configured to change a standby target temperature, which is a target in controlling a heating amount of the heating unit in a standby status, to a standby target temperature that is higher than normal, when the temperature decrease amount is greater than the threshold value.

* * * * *